US006960133B1

(12) United States Patent
Marks et al.

(10) Patent No.: US 6,960,133 B1
(45) Date of Patent: Nov. 1, 2005

(54) SLOT MACHINE GAME HAVING A PLURALITY OF WAYS FOR A USER TO OBTAIN PAYOUTS BASED ON SELECTION OF ONE OR MORE SYMBOLS (POWER PAYS)

(75) Inventors: Daniel M. Marks, Brooklyn, NY (US); Anthony M. Singer, Ringwood, NJ (US); Howard M. Marks, Westport, CT (US)

(73) Assignee: IGT, Reno, NV (US)

( * ) Notice: Subject to any disclaimer, the term of this patent is extended or adjusted under 35 U.S.C. 154(b) by 290 days.

(21) Appl. No.: 09/939,787

(22) Filed: Aug. 28, 2001

Related U.S. Application Data

(60) Provisional application No. 60/228,472, filed on Aug. 28, 2000.

(51) Int. Cl.[7] ..... A63F 9/24
(52) U.S. Cl. ..... 463/20; 463/16
(58) Field of Search ..... 460/16–20, 22–25, 460/30–31; 253/143 R, 138.1, 138.2, 139, 253/460; 463/16–22, 25–28

(56) References Cited

U.S. PATENT DOCUMENTS

| | | | | |
|---|---|---|---|---|
| 3,834,712 | A * | 9/1974 | Cox | 273/143 R |
| 4,184,683 | A * | 1/1980 | Hooker | 273/143 R |
| 4,648,600 | A * | 3/1987 | Olliges | 463/20 |
| 5,163,131 | A | 11/1992 | Row et al. | |
| 5,265,877 | A * | 11/1993 | Boylan et al. | 273/139 |
| 5,580,053 | A | 12/1996 | Crouch | |
| 5,704,835 | A * | 1/1998 | Dietz, II | 463/20 |
| 6,093,102 | A * | 7/2000 | Bennett | 463/20 |
| 6,120,378 | A * | 9/2000 | Moody et al. | 463/20 |
| 6,261,178 | B1 * | 7/2001 | Bennett | 463/20 |
| 6,270,412 | B1 * | 8/2001 | Crawford et al. | 463/20 |
| 6,290,600 | B1 * | 9/2001 | Glasson | 463/20 |
| 6,319,124 | B1 * | 11/2001 | Baerlocher et al. | 463/20 |
| 6,331,143 | B1 * | 12/2001 | Yoseloff | 463/18 |
| 6,334,814 | B1 * | 1/2002 | Adams | 463/20 |
| 6,336,860 | B1 * | 1/2002 | Webb | 463/22 |
| 6,443,837 | B1 * | 9/2002 | Jaffe et al. | 463/16 |
| 6,533,660 | B2 * | 3/2003 | Seelig et al. | 463/17 |
| 6,551,187 | B1 * | 4/2003 | Jaffe | 463/20 |
| 6,581,935 | B1 * | 6/2003 | Odom | 273/269 |
| 6,592,457 | B1 * | 7/2003 | Frohm et al. | 463/16 |
| 6,604,999 | B2 * | 8/2003 | Ainsworth | 463/20 |
| 6,731,313 | B1 * | 5/2004 | Kaminkow | 345/839 |

OTHER PUBLICATIONS

Boxer. Aaron. "Where Buses Cannot Go." *IEEE Spectrum*, Feb. 1995, pp. 41-45.

Barroso, Luiz André., Sasan Iman, Jaeheon Jeong, Koray Öner, and Michel Dubois. "RPM: A Rapid Prototyping Engine for Multiprocessor Systems." *IEEE Computer*, Feb. 1995, pp. 26-34.

Geddes, Robert N. *Slot Machines on Parade*. First Edition, The Mead Company. Long Beach, California. pp. 120, 127, 138.

* cited by examiner

*Primary Examiner*—Michael O'Neill
(74) *Attorney, Agent, or Firm*—Bell, Boyd & Lloyd LLC

(57) ABSTRACT

A method of playing a slot machine game in which a player wagers upon one or more symbols and then collect awards for combinations of two or more symbols wagered upon appearing in adjacent to each other in the symbol matrix. The slot machine game may also provide a symbol repositioning feature in which one or more symbols are moved from their original positions to other positions in the symbol matrix.

17 Claims, 23 Drawing Sheets

40

116

114

112

40

SLOT MACHINE GAME HAVING A PLURALITY OF WAYS FOR A USER TO OBTAIN PAYOUTS BASED ON SELECTION OF ONE OR MORE SYMBOLS (POWER PAYS)

RELATED APPLICATIONS

This application claims priority to application Ser. No. 60/228,472, filed Aug. 28, 2000, incorporated herein by reference.

BACKGROUND OF THE INVENTION

1. Field of the Invention

The present invention relates generally to payout methods in a mechanical, an electromechanical and/or computer-based slot machine-like games-of-chance and, more particularly, to a method, an apparatus, and a computer readable medium storing computer-executable instructions for enabling a player to select one or more symbols and to be awarded responsive thereto when a predetermined combination of the selected symbols are generated or displayed. In accordance with one feature of the present invention, the present invention utilizes the Contiguous Symbols concept as a method of payment for slot games, which awards Pays for "contiguous" combinations, any two or more symbols on the slot reels located adjacent to each other, or in a predetermined relationship with each other, in the horizontal, vertical and/or diagonal direction.

The present invention optionally further provides the player the capability to receive bonus credits independent of any combination of player-selected symbol(s). In alternative embodiments of the present invention, "contiguous" combinations may represent any predetermined combination of the same or different symbols in a predesignated configuration.

2. Background Description

In a conventional slot machine, symbols are displayed on 3 or more columns placed adjacent to each other. Each column contains at least three rows, with a symbol in each row. The resulting matrix of symbols ("Symbol Matrix") ranges from 3 columns by 3 rows with 9 total symbols to 5 columns by 3 rows with 15 total symbols. Within the Symbol Matrix, positions on the slot reels may be referred to according to column, from left to right, and row, from top to bottom ("Symbol Positions") For example: Symbol Position 1/2 is located in column 1 (i.e., left-most column) and row 2 (i.e., middle row).

Players collect credits for specific combinations of symbols ("Pays") that appear in Contiguous lines. Pays typically contain 3 or more of the same symbols. Paylines usually start from column 1, or the left most column, and proceed across to the column 5, the right-most column ("Left-to-Right"), or vice-versa ("Right-to-Left"). For example, a player may collect credits if 3 Clown symbols appeared in Symbol Positions 1/1, 2/1, 3/1 on a Left-to-Right payline using symbol positions 1/1, 2/1, 3/1, 4/1, and 5/1.

As shown in FIG. 1, U.S. Pat. No. 5,580,053 to Crouch, entitled Multi-Line Gaming Machine, incorporated herein by reference, discloses a gaming machine 30 that has a display 32 on which an array of symbols is displayed. The array is typically 3 rows×5 columns. During a game the symbols displayed on the array are caused to change with a random result being obtained. The player of the machine makes a wager on the result and is paid a prize if one of a number of predetermined combinations of symbols are displayed on a line of the display 32 at the end of the game. The player may make multiple wagers on each game with each wager being assigned to a different one of a plurality of possible result lines. Typically, the number of possible result lines is greater than or equal to 9, and the lines to be employed in each game are selected by switches 34, prior to a game being initiated.

FIG. 2, as disclosed in U.S. Pat. No. 5,580,053, shows a 3×5 display 51 having 12 paylines, indicated by numerals 1 to 12 in the Figure. FIG. 3, as disclosed in U.S. Pat. No. 5,580,053, shows a 3×5 display 51 having 27 paylines, indicated by numerals 1 to 27 on the Figure. U.S. Pat. No. 5,580,053 also states that machines having a 3×3 or 3×4 display size.

Conventional slot machines, such as those disclosed above, using the Pay Line concept do not award credits to players under one or more of the following conditions:

- Any symbol in a Pay is not on a Pay Line. To award credits, every symbol in a Pay must appear on the specific positions of a Pay Line. For example: a slot machine with Pay Line 1 using 1/1, 2/1, 3/1, 4/1, and 5/1 does not award credits for 3 clown symbols at 1/1, 2/1, 3/2. The clown symbol at 3/2 is not located on the Pay Line; and
- No credits have been wagered on a Pay Line. To award credits, a Pay must appear on a Pay Line that has been wagered upon. For example: a slot machine with a wager only on Pay Line 1 does not award credits if 3 clown symbols appear on Pay Line 2.

As a result of these limitations, the Pay Lines concept causes slot players the following frustrations:

- Players must memorize all of the payline positions. Pay Lines are hard to follow as they zigzag across the reels and intersect with other Pay Lines. The player is forced to memorize the exact locations of each of the Symbol Positions associated with the Pay Lines.
- Players must wager on every Pay Line. Slot games with multiple Pay Lines are expensive to wager upon. To wager upon each Pay Line, the player must bet at least 1 credit per Pay Line, thereby significantly increasing the credits per spin and the cost to the player, without any perceived value by the player.

SUMMARY OF THE INVENTION

With the foregoing problems in mind, it is one feature and advantage of the present invention to provide a slot machine which does not use the Pay Line concept and suffer from the associated limitations. As the number of Pay Lines increases with each new generation of slot games, all of these limitations also increase. By paying for all combinations of contiguous symbols, however, the Contiguous Symbols concept offers players a slot game with a wider variety of Pays that are simpler to understand and cheaper to wager upon. This Contiguous Symbols concept enables players to select a symbol that optionally provides a potential payout associated with the symbol position, rather than a Pay Line position.

In accordance with the Contiguous Symbols concept, the method according to the present invention thus eliminates the traditional, limited, fixed Pay Lines and allows the player to optionally collect an award along any Contiguous line(s) when any of two or more selected predetermined symbols appear contiguously along the Contiguous line.

The present invention advantageously and optionally awards bonus credits, independent of any player-selected symbol(s). The game awards the player based both on his intuitive choice of symbols, and randomly (i.e., independent of the player-selected symbols) when, for example, the appearance of two or more predefined symbols anywhere within the display area.

An exemplary embodiment of the present invention further includes bonus payouts that occur, for example, when two or more of the same predetermined symbols (e.g., big top bonus tickets) appear anywhere within the display. If two of the above-mentioned predetermined symbols appear anywhere on the display, the player will receive double the amount of credits that he wagered.

If, for example, three of the same predetermined symbols (e.g., big top circus tickets, etc.) appear on the display, a trapeze may be presented on another display, and the player can collect credits for successfully directing an animated monkey across the trapeze bars.

Note that this aspect of the game links the random and intuitive concepts. That is, the initial screen presenting the trapeze occurs purely by chance. There is no prior knowledge or skill needed on the part of the individual. It has nothing to do with and is completely independent of any selection by the player of symbols. However, once the trapeze appears, the player intuitively selects the direction that he feels will win the most credits and, if the player is correct, can obtain additional credits.

The present invention utilizes the Contiguous Symbols concept as a method of payment for slot games. Contiguous Symbols awards Pays for "contiguous" combinations of symbols on two or more adjacent or predetermined Symbol Positions on the slot reels. The term "contiguous" refers to any 2 or more symbols on the slot reels adjacent to each other, or in a predetermined relationship with each other, in one or more of the horizontal, vertical and/or diagonal direction. For example, using the letters A through H as symbols on a 5-reel slot machine:

| | | | | |
|---|---|---|---|---|
| A(1) | A(2) | H(2) | F | D |
| A(3) | H(1) | B | H(3) | H(4) |
| E | A(4) | A(5) | A(6) | G |

This example results in multiple sets of "contiguous" symbols, such as: symbols A(1)-A(2) located horizontally contiguous to each other; symbols A(1)-A(3) located vertically contiguous to each other; and symbols H(1)-H(2) located diagonally contiguous to each other. Note, however, that symbols A(1)-A(4) are not contiguous to each other in accordance with this embodiment. In other embodiments, the same of predetermined set of symbols are merely in a predetermined configuration and/or relationship.

Contiguous Symbols may start in any location and form combinations in any direction or combination of directions. In a preferred embodiment of the present invention, Contiguous Symbols pay for all combinations of 2 or more same symbols formed in any direction, with each Contiguous Symbol combination starting, for example, in the left-most column, continuing Left-to-Right, and using only 1 symbol per column. For example, using the letters A through H as symbols on a 5-reel slot machine:

| | | | | |
|---|---|---|---|---|
| A(1) | A(2) | H(2) | F | D |
| A(3) | H(1) | B | H(3) | H(4) |
| E | A(4) | A(5) | A(6) | G |

Using the rules associated with the preferred embodiment, this example results in three Contiguous Symbol combinations: A(1)-A(2), A(3)-A(2), and A(3)-A( 4)-A(5)-A(6). Under other sets of rules, however, the same example results in the following Contiguous Symbol combinations:

Three combinations from left-to-right, with 1 symbol per column: A(1)-A(2); A(3)-A(2); A(3)-A( 4)-A(5)-A(6).

One combination from right-to-left, with 1 symbol per column: H(4)-H(3)-H(2)-H(1);

Two combinations from top-to-bottom, with 1 symbol per row: A(1)-A(3)-A(4) and A(2)-A(3)-A(4);

Two combinations from bottom-to-top, with 1 symbol per row: A(4)-A(3)-A(1) and A(4)-A(3)-A(2);

One combination along the same column: A(1)-A( 3);

One combination along with same row that does not start in the left-most or right-most columns: A(4)-A(5)-A(6);

One combination using only the diagonal direction that does not start in the left-most or right-most columns: H(1)-H(2)-H(3); and A variety of other combinations using multiple directions and/or multiple of the same or different symbols per column/row: A(1)-A(2)-A(3)-A(3)-A(1); A(1)-A(2)-A(3); A(6)-A( 5)-A(4); A(6)-A(5)-A(4)-A(3); A(1)-A(3)-A(4)-A( 5)-A(6); A(6)-A(5)-A(4)-A(3)-A(1); A(2)-A(3)-A( 4)-A(5)-A(6); A(1)-A(2)-A(3)-A(4)-A(5)-A(6); A(6)-A(5)-A(4)-A(3)-A(2); A(6)-A(5)-A(4)-A(3)-A( 2)-A(1); and more.

Contiguous Symbols may be used one or more times to form different combinations. In the preferred embodiment, each symbol may be used to make any and all Contiguous Symbol combinations from left-to-right, using 1 symbol per column. For example, using the letters A through H as symbols on a 5-reel slot machine:

| | | | | |
|---|---|---|---|---|
| A(1) | A(2) | H(2) | F | D |
| A(3) | H(1) | B | H(3) | H(4) |
| E | A(4) | A(5) | A(6) | G |

Using the rules associated with the preferred embodiment, this example results in 2 Contiguous Symbol combinations that both use symbol A(1): A(1)-A(2), A(1)-A(3). Under other sets of rules, however, the same example results in additional Contiguous Symbol combinations that use symbols A(1), such as: A(1)-A(2)-A( 3) and A(1)-A(2)-A(3)-A(4)-A(5)-A(6).

Contiguous Symbols may also interact with wild symbols to form combinations. A wild symbol replaces any other symbol, or sub-set of symbols, to form a Contiguous Symbol combination. In the preferred embodiment, a Wild symbol interacts with all of the symbols in the symbol set. For example, using the letters A through H as symbols on a 5-reel slot machine and using the g symbol as a Wild symbol:

| | | | | |
|---|---|---|---|---|
| A(1) | A(2) | H(2) | F | D |
| A(3) | H(1) | B | H(3) | H(4) |
| E | A(4) | A(5) | A(6) | G |

Using the rules associated with the preferred embodiment, this example results in 1 Contiguous Symbol combinations that both use the G Wild symbol: A(3)-A( 4)-A(5)-A(6)-G. Under other sets of rules, however, the same example results in additional Contiguous Symbol combinations that use the G Wild symbol, such as: G-H(3)-H(2)-H(1) and G-A(6)-A(5)-A(4)-A(3).

In accordance with one embodiment of the invention a method of playing a game is described, having a display area or game board which comprises a plurality of rows intersecting or meeting with a plurality of columns. The plurality of rows and columns include a plurality of symbols, comprising the steps of (a) selecting by a player at least one symbol from the plurality of symbols; (b) randomly rearranging the plurality of symbols; (c) displaying the rearranged symbols; and (d) awarding the player responsive to at least two predetermined symbols or combination of predetermined symbols appearing substantially contiguously within the display area and the at least two predetermined symbols or the combination of predetermined signals were selected by the player in said selecting step (a).

In accordance with another embodiment of the invention a method of playing a game is described wherein said awarding step (d) further comprises the step of awarding the player responsive to the at least two predetermined symbols or combination of predetermined symbols appearing substantially contiguously within the display area including at least one of up-down contiguous, down-up contiguous, diagonal left-right contiguous, diagonal right-left contiguous, and any combination thereof.

In accordance with another embodiment of the invention a method of playing a game is described wherein said awarding step (d) further comprises the step of awarding the player responsive to the at least two predetermined symbols or combination of predetermined symbols appearing substantially contiguously within the display area including at least one of multiple directions and multiple of the same or different symbols for at least one of a column and a row within the display area.

In accordance with another embodiment of the invention a method of playing a game is described which further comprises the steps of wagering by the player selecting a number of the plurality of symbols to wager upon, and setting a wager value for each of the plurality of symbols selected.

In accordance with another embodiment of the invention a method of playing a game is described which further comprises the steps of wagering by the player selecting a number of the plurality of symbols to wager upon, each of the plurality of symbols selected having a same wager value.

In accordance with another embodiment of the invention a method of playing a game is described which further comprises the steps of wagering by the player selecting a number of the plurality of symbols to wager upon, each of the plurality of symbols selected having a different wager value.

In accordance with another embodiment of the invention a method of playing a game is described wherein said awarding step (d) further comprises the step of awarding the player responsive to the at least two predetermined symbols or combination of predetermined symbols appearing substantially contiguously within the display area including at least one combination of: at least two of the same plurality of symbols, formed in any direction, starting in a left-most column of the display area, continuing left-to-right, using only one symbol per column, and comprised of the plurality of symbols selected by the player.

In accordance with another embodiment of the invention a method of playing a game is described wherein said awarding step (d) further comprises the step of awarding the player responsive to the at least two predetermined symbols or combination of predetermined symbols appearing substantially contiguously within the display area including a wild symbol representing any of the plurality of symbols or sub-set of the plurality of symbols, to form the substantially contiguous symbol combination.

In accordance with another embodiment of the invention a method of playing a game is described wherein said awarding step (d) further comprises the step of awarding the player responsive to the at least two predetermined symbols or combination of predetermined symbols appearing substantially contiguously within the display area including at least one of the following bonus eligible combinations. (1) At least one first predetermined symbol appears on at least one of a predetermined position, column and row, triggering a reposition of at least one of the plurality of symbols on the display area to create a most valuable winning combination ("Most Valuable Placing"). (2) At least two second predetermined symbols appear anywhere in the display area and award the player a predetermined amount. (3) At least three third predetermined symbols appear anywhere in the display area resulting in a bonus game, wherein a bonus is awarded responsive to the player performing actions to successfully win the game. (4) At least two fourth predetermined symbols appear anywhere on the display area resulting in a another bonus game, wherein another bonus is awarded responsive to the player is awarded credits for playing the another bonus game not requiring specific actions from the player.

In accordance with another embodiment of the invention a method of playing a game is described wherein said bonus eligible combination (1) includes repositioning the at least one symbol via an animated monkey for at least one symbol position in the display area.

In accordance with another embodiment of the invention a method of playing a game is described wherein said bonus eligible combination (3) includes the player inputting controls to direct an animated monkey across a trapeze.

In accordance with another embodiment of the invention a method of playing a game is described wherein said bonus eligible combination (4) includes firing an animated monkey out of a cannon and into piles of bananas.

In accordance with another embodiment of the invention a method of playing a game is described wherein said bonus eligible combination (1) includes repositioning the at least one symbol via an Most Valuable Placing ("MVP") to create the most valuable winning combinations, in at least one of the following manner: (1) at least one of the plurality of symbols is moved to another position and awarded a payout; (2) each of the plurality of symbols is moved to multiple positions and awarded payouts for at least one of the positions; (3) MVP may be triggered randomly, by at least one of a predetermined symbol(s), a random event, and a predetermined event.

In accordance with another embodiment of the invention a method of playing a game is described wherein said bonus eligible combination (1) includes repositioning the at least one symbol via an Most Valuable Placing ("MVP") to create the most valuable winning combinations, in at least one of the following manner: (a) overlapping the at least one symbol with another symbol to allow at least two symbols to occupy a same symbol position; (b) merging the at least one symbol with another symbol to form a new symbol having predetermined properties; (c) revealing at least one other symbol in a position the at least one symbol vacates, thereby concealing underneath the at least one symbol being repositioned.

In accordance with another embodiment of the invention a method of playing a game is described wherein at least one of the at least two second predetermined symbols are one of same and different, the at least three third predetermined symbols are one of same and different, and the at least two fourth predetermined symbols are one of same and different.

In accordance with another embodiment of the invention a method of playing a game is described wherein said awarding step (d) further comprises the step of awarding the player responsive to the at least two predetermined symbols or combination of predetermined symbols appearing substantially contiguously within the display area including at least two of the plurality of symbols on the display area being at least one of located adjacent to each other, and in a predetermined relationship with each other, in at least one of a horizontal, vertical and diagonal direction.

In accordance with another embodiment of the invention a method of playing a game is described wherein said awarding step (d) further comprises the step of awarding the player responsive to the at least two predetermined symbols or combination of predetermined symbols appearing substantially contiguously within the display area are one of the same and different.

In accordance with another embodiment of the invention a method of playing a game is described having a display area or game board comprising a plurality of rows intersecting or meeting with a plurality of columns. The plurality of rows and columns include a plurality of symbols, comprising the steps of: (a) assigning at least one symbol from the plurality of symbols for the player to be used in playing the game; (b) randomly rearranging the plurality of symbols; (c) displaying the rearranged symbols; and (d) awarding the player responsive to at least two predetermined symbols or combination of predetermined symbols appearing substantially contiguously within the display area and the at least two predetermined symbols or the combination of predetermined signals were assigned to the player in said assigning step (a).

In accordance with another embodiment of the invention a method of playing a game is described having a display area or game board comprising a plurality of rows intersecting or meeting with a plurality of columns. The plurality of rows and columns include a plurality of symbols, comprising the step of awarding a player responsive to at least one of the following bonus eligible combinations: (1) at least one first predetermined symbol appears on at least one of a predetermined position, column and row, triggering a reposition of at least one of the plurality of symbols on the display area to create a most valuable winning combination ("Most Valuable Placing"); (2) at least two second predetermined symbols appear anywhere in the display area and awarding the player a predetermined amount; (3) at least three third predetermined symbols appear anywhere in the display area resulting in a bonus game, wherein a bonus is awarded responsive to the player performing actions to successfully win the game; and (4) at least two fourth predetermined symbols appear anywhere on the display area resulting in a another bonus game, wherein another bonus is awarded responsive to the player is awarded credits for playing the another bonus game not requiring specific actions from the player.

In accordance with another embodiment of the invention a method of playing a game is described wherein said bonus eligible combination (1) includes repositioning the at least one symbol via an animated monkey for at least one symbol position in the display area.

In accordance with another embodiment of the invention a method of playing a game is described wherein said bonus eligible combination (3) includes the player inputting controls to direct an animated monkey across a trapeze.

In accordance with another embodiment of the invention a method of playing a game is described wherein said bonus eligible combination (4) includes firing an animated monkey out of a cannon and into piles of bananas.

In accordance with another embodiment of the invention a method of playing a game is described wherein said bonus eligible combination (1) includes repositioning the at least one symbol via an Most Valuable Placing ("MVP") to create the most valuable winning combinations, in at least one of the following manner. At least one of the plurality of symbols is moved to another position and award a payout. Each of the plurality of symbols is moved to multiple positions and awarded payouts for at least one of the positions. MVP may be triggered randomly, by at least one of a predetermined symbol(s), a random event, and a predetermined event.

In accordance with another embodiment of the invention a method of playing a game is described wherein said bonus eligible combination (1) includes repositioning the at least one symbol via an Most Valuable Placing ("MVP") to create the most valuable winning combinations, in at least one of the following manner. The at least one symbol is overlapped with another symbol to allow at least two symbols to occupy a same symbol position. The at least one symbol is merged with another symbol to form a new symbol having predetermined properties. The at least one other symbol is revealed in a position the at least one symbol vacates, thereby concealing underneath the at least one symbol being repositioned.

In accordance with another embodiment of the invention a method of playing a game is described wherein at least one of the at least two second predetermined symbols are one of same and different, the at least three third predetermined symbols are one of same and different, and the at least two fourth predetermined symbols are one of same and different.

In accordance with another embodiment of the invention a method of playing a game is described having a display area or game board comprising a plurality of rows intersecting or meeting with a plurality of columns. The plurality of rows and columns include a plurality of symbols, comprising the steps of (a) randomly rearranging the plurality of symbols; (b) displaying the rearranged symbols; and (c) awarding the player responsive to at least two predetermined symbols or combination of predetermined symbols appearing substantially contiguously within the display area on any of the predetermined contiguous lines. All of the predetermined contiguous lines represent all possible predetermined contiguous line combinations and are eligible for said awarding.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other systems and methods for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The Detailed Description including the description of a preferred structure as embodying features of the invention will be best understood when read in reference to the accompanying figures wherein.

The same reference numerals refer to the same parts through the various figures.

NOTATIONS AND NOMENCLATURE

Figure 1:
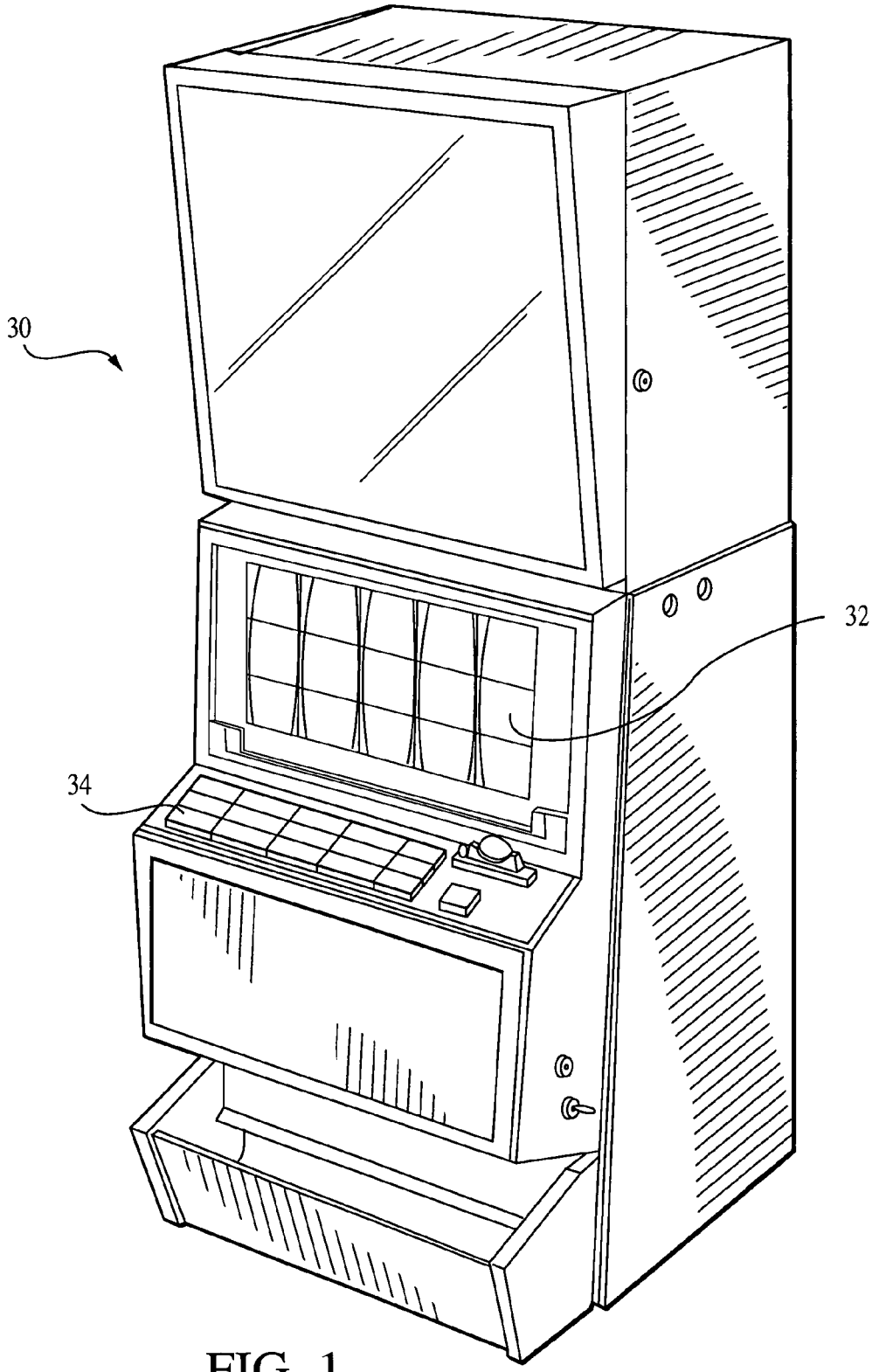
FIG. 1 PRIOR ART
FIG. 1 illustrates a prior art slot machine.
Figure 2:
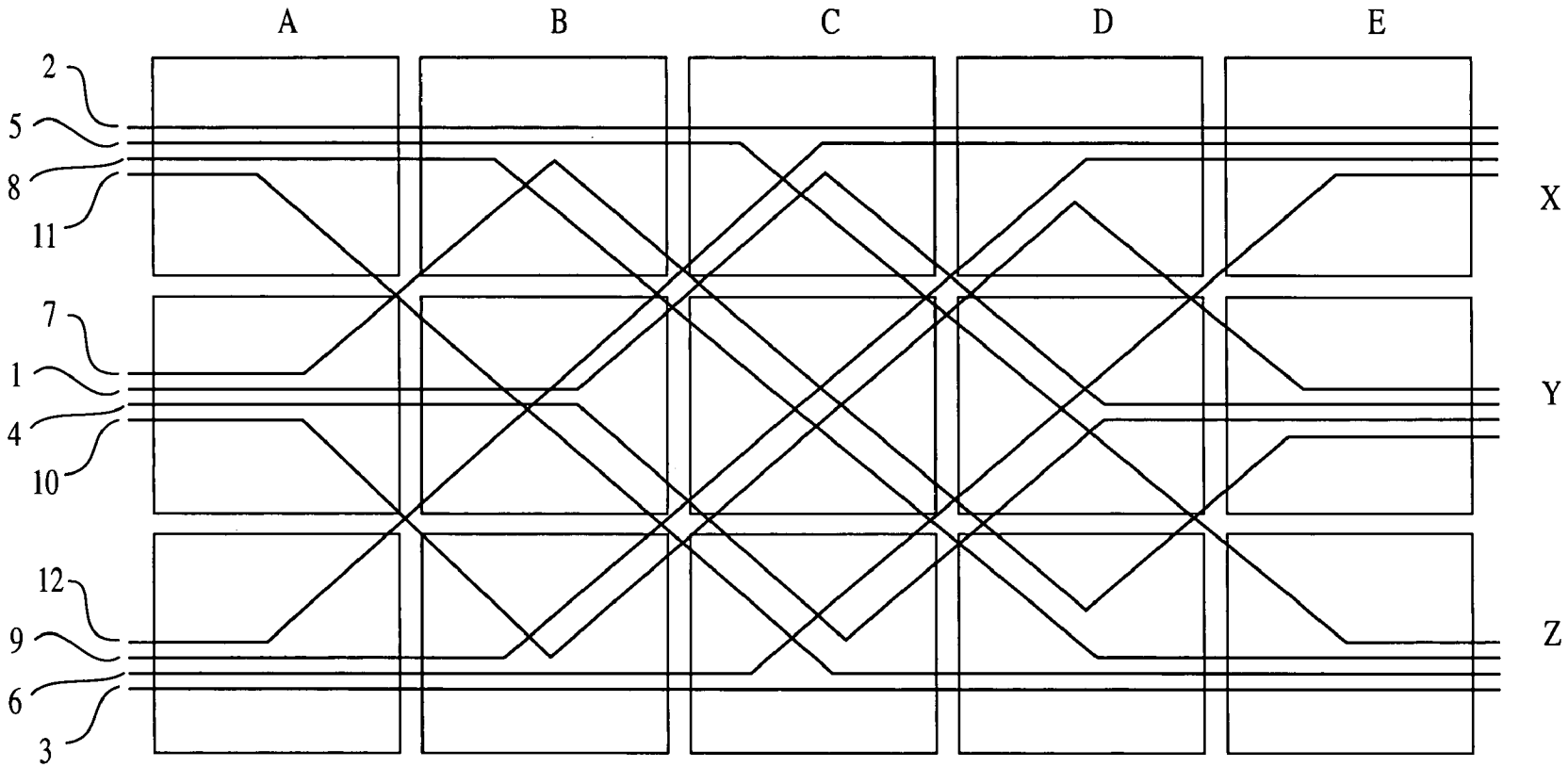
FIG. 2 PRIOR ART
FIG. 2 diagrammatically illustrates a prior art 12 line multi-line pay arrangement for a machine with a 3×5 display format.
Figure 3:
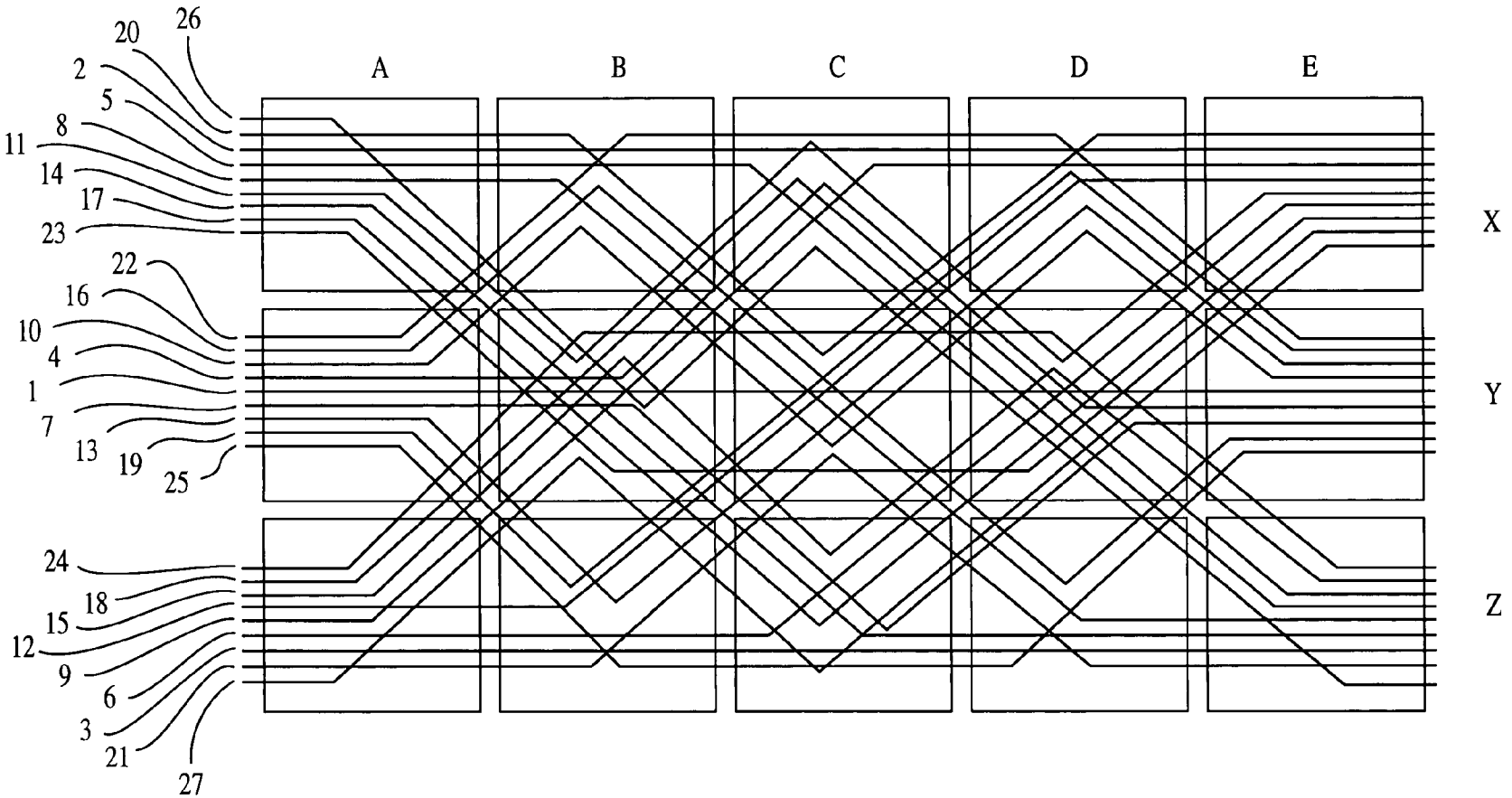
FIG. 3 PRIOR ART
FIG. 3 diagrammatically illustrates a prior art 27 line multi-line pay arrangement for a machine with a 3.times.5 display format.
Figure 4A:
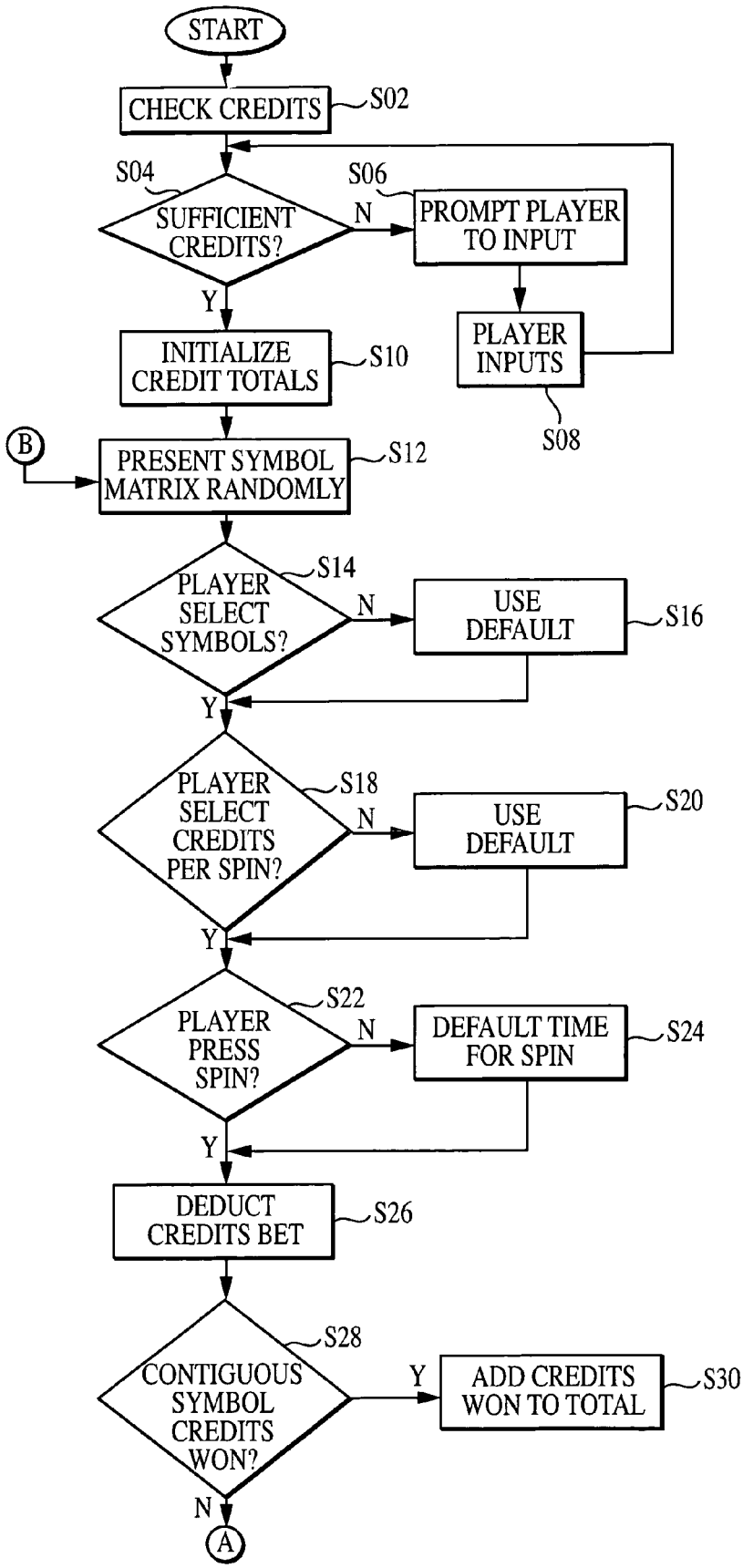
FIGS. 4*a*–4*b*, taken together, is a flowchart depicting a preferred embodiment of the present invention.
Figure 4B:
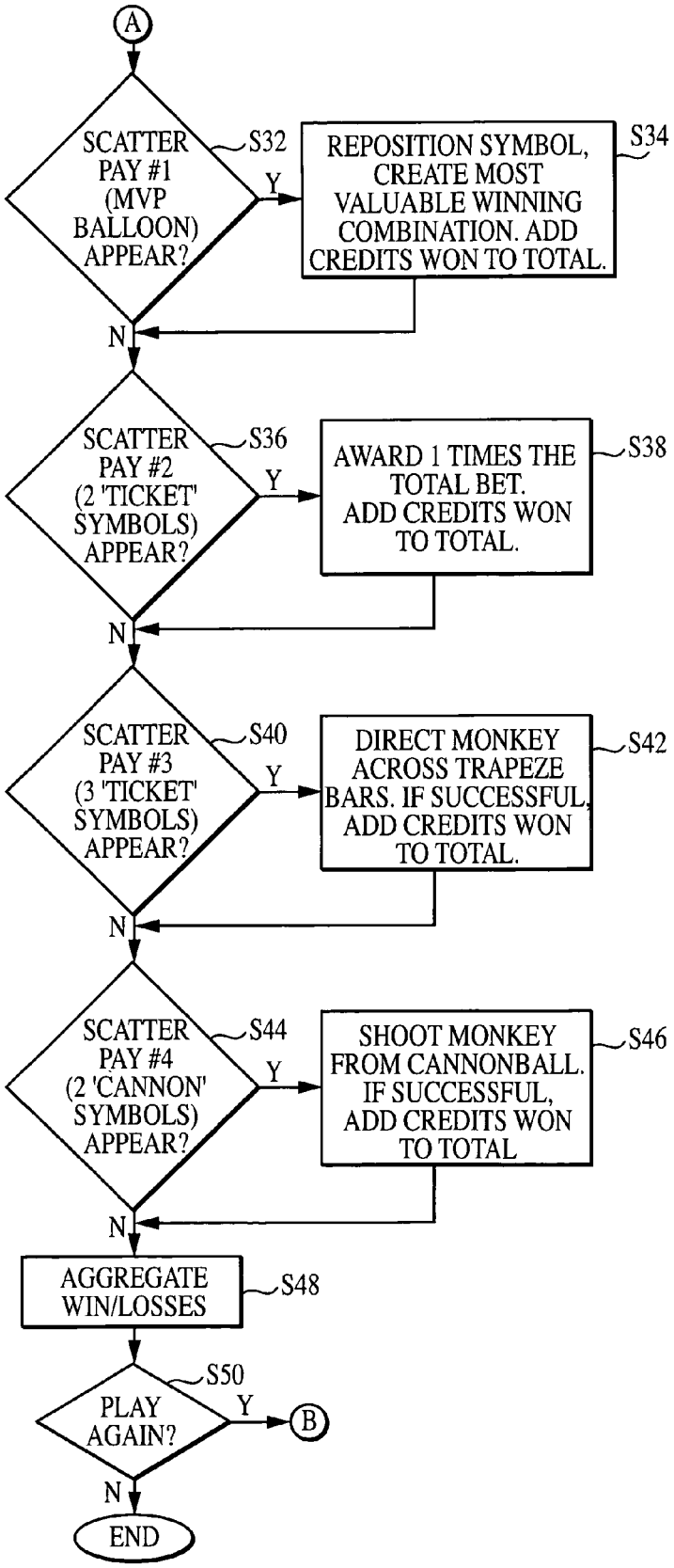

The detailed descriptions which follow may be presented in terms of program procedures executed on a computer or network of computers. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine and/or manual operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

DETAILED DESCRIPTION OF PREFERRED EMBODIMENTS OF THE INVENTION

Reference now will be made in detail to the presently preferred embodiments of the invention. Such embodiments are provided by way of explanation of the invention, which is not intended to be limited thereto. In fact, those of ordinary skill in the art may appreciate upon reading the present specification and viewing the present drawings that various modifications and variations can be made.

For example, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

The preferred embodiment of the present invention includes the play of the base game and additional bonus features, including new Wild symbols and Scatter pay features, as described below;

Base Game. To play the base game, the player establishes a pool of credits, sets the wager, spins the reels, and collects credits for winning Contiguous Symbol combinations and bonus features.

Figure 5:
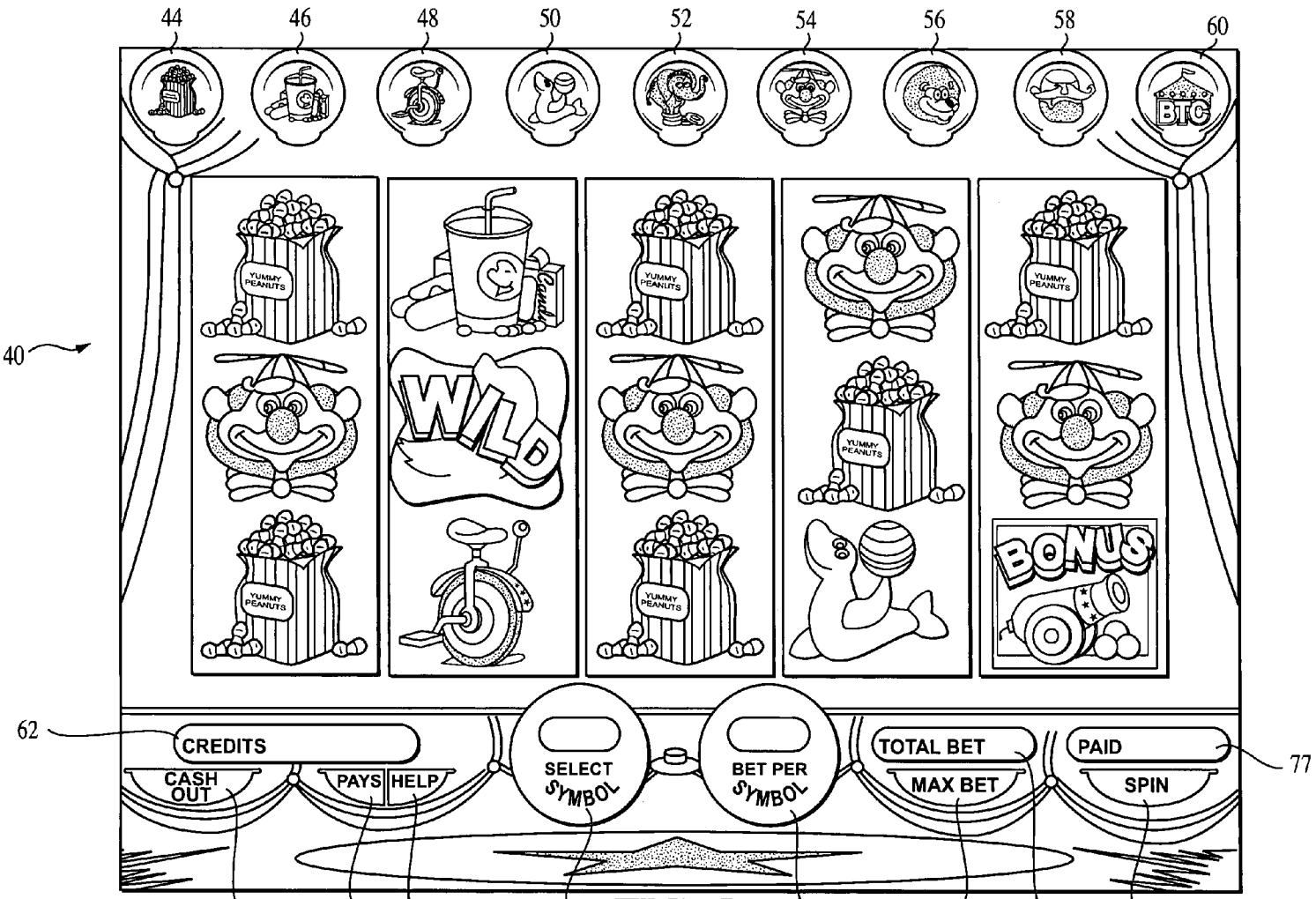
FIG. 5 shows an illustrative example of a representative display that may be encountered during a typical game in accordance with the principles of the present invention.

Video Display. In a preferred embodiment of the present invention, the slot game has a 5-reel display using a 5 column by 3 row matrix with 15 Symbol Positions, as shown in FIG. 5. Alternatively, the game could utilize any number of columns and reels, such as a 3 column by 3 row matrix with 9 symbol positions.

Buttons. In a preferred embodiment of the present invention, a set of buttons control the functions of the slot game, including Select Symbols, Set Bet Per Symbol, Max bet, Spin Reels, Pay Table, and Help. Any or all of these control buttons may be displayed on the video display and/or buttons hard-wired to the gaming device. If necessary, any number of buttons may be added or combined to alternatively or further facilitate control of the games.

Meters. In the preferred embodiment of the present invention, a set of meters displays the game's salient information, including Number of Symbols, Amount Bet Per Symbol, Total Bet and Paid, as illustrated in FIG. 5. The Number of Symbols button is associated with the Bet Per Symbol button and displays the number of credits wagered per Symbol; Total Bet displays the cumulative value of the Number of Symbols and Amount Bet per Symbol; Paid displays the number of credits won on the last spin; and Credits displays the total number credits remaining in the credit pool.

Credit Pool. In a preferred embodiment of the present invention, the player deposits coins, tokens or paper currency into a coin head slot or a paper currency bill acceptor to establish a pool of credits. The amount of this common pool of credits is displayed to the player on a credit meter. The pool of credits increases and decreases according to the player's win or losses and may be supplemented, if necessary, by the player by additional deposits of coins, tokens or paper currency.

Set Wager. In the preferred embodiment of the present invention, the player sets the wager by selecting the number of symbols to wager upon and setting the wager per symbol:

1) Select Symbols. In a preferred embodiment of the present invention, the slot game has a plurality of symbols upon which to wager. The symbols wagered on by the player would be activated in a pre-determined order. For example, the slot game may utilize 8 symbols of which the player's first wager is applied to symbols 1, the second wager is applied to symbol 2 the third wager is applied to symbol 3, and the Nth wager is applied to symbol N.

2) Bet per Symbol. In a preferred embodiment of the present invention, the player sets the value of the wager on each symbol; the same amount is wagered on each symbol. Alternatively, the player could be allowed to make wagers of different amounts on each symbol. The total amount wagered is determined by summing the amounts wagered on each symbol. Alternative methods may optionally be used, for example, having a standard bet and/or symbol bet or all symbols to be wagered each game.

Spin Reels. In a preferred embodiment of the present invention, the player then causes the slot machine to operate by effecting a "spin" of the reels. This can be done in any suitable manner, such as the player pressing a "spin" button on the machine's button panel and watching a video simulation of a reel slot machine, or actually pulling a lever, and the like.

Symbol Set. In a preferred embodiment of the present invention, each symbol is chosen from a set of thirteen symbols. For each spin, the machine randomly displays 3 symbols from the symbol set on each reel. A common theme can be used for the symbols, and in one embodiment, the symbols are related to a circus theme. However, any suitable symbols and/or number of symbols may be used, including the traditional fruit symbols that commonly appear on other slot machines.

Winning Symbol Combinations. In the preferred embodiment of the present invention, the player receives Pays for all Contiguous Symbol combinations of:

2 or more same symbols;
formed in any direction;
starting in the left-most column;
continuing left-to-right
using only 1 symbol per column
comprised of symbols wagered upon by the player.

The player, therefore, only receives Pays for Contiguous Symbol Combinations comprised of a symbol wagered upon by the player. Each combination awards the Pay indicated on the game's pay table times the amount wagered on that symbol. Any appropriate pay table may be used in the present invention and each slot game may use its own pay table and/or common pay tables.

Alternatively, or in addition, any predetermined combination providing the appropriate return percentage may constitute or compromise the contiguous pays of the present invention. For example, contiguous pays may constitute the same symbol appearing anywhere on the display a predetermined number of times. Alternatively or in addition, every other column and/or row the same symbol appears may be considered a winning combination. Alternatively, or in addition, predetermined combinations of different symbols, optionally in predetermined combinations or number may also be considered a winning combination.

Bonus Features. During play of the base game, the player may receive special pays for bonus features, such as new Wild Symbols and Scatter pay bonus features in accordance with the present invention indicated by predetermined symbols replace any or all other symbols in determining winning outcomes. Alternatively, wild symbols may only replace limited subsets of the other symbols, for example, symbols bet upon by the player or randomly selected symbols. Wild symbols, therefore, increase the possibility of a player achieving winning combinations, and the pay table must reflect that the wild symbols are in use. In a preferred embodiment of the present invention, the wild symbol acts as its own symbol (e.g., three wild symbols on a contiguous line) while at the same time a wild symbol could also advantageously simultaneously replace every other symbol. Alternatively, any suitable replacement rules for wild symbols could be used.

Each wild symbol may also be used to affect payouts which utilize one or more wild symbols. For example, a wild symbol used in a winning combination of symbols may enhance the winning, such as double the value of winning combination. The slot game can also be configured so that the wild symbols increase or decrease the value of any payout in any manor which results in an average or predetermined value that can be utilized to control the gaming machine's overall average payouts. In the preferred embodiment of the present invention, however, the Wild Symbols do not affect the value of the winning symbol combinations.

Scatter Pays. A scatter pay awards the player a predetermined payout for the appearance of a scatter symbols, or combination of scatter symbols, in any Symbol Position on the reels ("Scatter Pay"). If more than one Scatter symbol is required to form a Scatter Pay, the scatter symbols in one embodiment of the invention, do not need to be "contiguous" or located in adjacent positions. Scatter Pays award a specific number of credits and/or trigger a bonus feature, such as entertaining animations, free spins, enhanced pay table values, and/or selection of bonus object as described below in detail. The number of credits awarded may be determined by multiplying the total amount wagered by a random number within a predetermined range of numbers; or, the number of free spins awarded may be set by the number and/or arrangement of scatter symbols displayed on the reels. Alternatively, the value of the bonus feature could be determined by any other suitable calculation, such as a calculation or method where the bonus feature results in an average value that can be utilized to control the overall average payouts of the slot game.

In a preferred embodiment of the present invention, there are 4 Scatter Pays used to trigger bonus credit awards and bonus features:

1. Any 1 or more Balloon symbols on reel 5 (or other predetermined position) triggers the first Scatter Pay in which an animated monkey repositions one or more of the symbols on the reels to create the most valuable winning combinations ("Most Valuable Placing").
2. Any two tickets appearing anywhere in the screen trigger the second Scatter pay, which awards the player twice the amount of credits he wagered.
3. Any three of these tickets appear, a bonus game is activated involving a trapeze. The player can collect credits for successfully directing the monkey across trapeze bars.
4. Furthermore, any two cannon symbols on the display triggers a different bonus game, wherein a player is awarded credits for firing an animated monkey out of a cannon and into piles of bananas.

Of course, any of the above scatter pays may be modified where more or less number of symbols, contiguous or not, may be utilized.

Of these four Scatter Pays, the Most Valuable Placing scatter pay deserves further description. Most Valuable Placing ("MVP") repositions one or more of the symbols on the reels to create the most valuable winning combinations, in the following manner:

Any or all of the symbols may be moved to another position and award a payout; and/or Each symbol may be moved to multiple positions and award payouts for up to all of the positions; and/or MVP may be triggered randomly, by a predetermined symbol(s), or some other random or predetermined event.

In one embodiment of the present invention, MVP is triggered by the appearance of a Balloon symbol in the right-most column. The game, for example, via the monkey for enhanced enjoyment and/or excitement, then repositions one symbol, one time, to produce the largest award possible given the symbols displayed on the reels. If no additional award can be produced, the game awards the player one times the total bet wagered, or other predetermined amount.

For example, using the letters A through H as symbols on a 5-reel slot machine and using the D symbol as a Balloon symbol, one possible resulting display is as follows:

| | | | | |
|---|---|---|---|---|
| A(1) | B(1) | F | F | D |
| C(1) | H(1) | B(2) | C(2) | H(2) |
| E | A(2) | A(3) | A(4) | G |

Using the rules associated with the preferred embodiment, this example contains no Contiguous Symbol combinations. With the D symbol triggering MVP, however, the game must decide whether to reposition symbol A(1), B(2), C(2), or H(2) to form a Contiguous Symbol combination. The pay table for the preferred embodiment shows that moving symbol A(1) produces the largest award. The game repositions symbol A(1) from Symbol Position 1/1 to 1/3, as shown in the example below:

| | | | | |
|---|---|---|---|---|
| ^ | B | F | F | D |
| C | H | B | C | H |
| A(1) | A(2) | A(3) | A(4) | G |

MVP, therefore, results in a new Pay for the Contiguous Symbol combination of A(1)-A(2)-A(3)-A(4).

The MVP bonus feature is not limited to repositioning symbols to form combinations of Contiguous Symbols. MVP may also reposition Wild symbols, Scatter symbols and any other symbol or element in the slot game. For example, using the letters A through H as symbols on a 5-reel slot machine and using the G symbol as a Wild symbol and the D symbol as a Balloon symbol, one exemplary display is as follows:

| | | | | |
|---|---|---|---|---|
| A(1) | B(1) | F | F | D |
| C(1) | H(1) | B(2) | C(2) | H(2) |
| E | A(2) | A(3) | A(4) | G |

Using the rules associated with the preferred embodiment, this example results in no Contiguous Symbol combinations. With the G symbol acting as Wild Symbol and the D symbol triggering MVP, however, the game repositions symbol G from Symbol Position 5/3 to 1/2, as shown in the example below:

| | | | | |
|---|---|---|---|---|
| A(1) | B(1) | F | F | D |
| G | H(1) | B(2) | C(2) | H(2) |
| E | A(2) | A(3) | A(4) | ^ |

MVP, therefore, results in three new Pays for the Contiguous Symbol combinations: G-A(2)-A(3)-A(4), G-B(1), G-H(1).

Furthermore, the MVP bonus feature is not limited to simply repositioning one symbol over another. The symbol repositioned by MVP may also optionally:

Overlap with another symbol to allow for 2 symbols to occupy the same Symbol Position as shown in the examples below in which the game repositioned symbol A(1) from Symbol Position 1/1 to 1/3:

| | | | | |
|---|---|---|---|---|
| A(1) | B | F | F | D |
| G | E(2) | B | C | H |
| E(1) | A(2) | A(3) | A(4) | G |
| | | [Before Reposition] | | |
| ^ | B | F | F | D |
| C | E(2) | B | C | H |
| E(1)/A(1) | A(2) | A(3) | A(4) | G |
| | | [After Reposition] | | |

By allowing the A(1) and E(1) symbols to occupy the same Symbol Position, MVP results in one new Pay for the Contiguous Symbol combination of A(1)-A( 2)-A (3)-A(4), plus the original E(1)-E(2).

Merge with another symbol to form a new symbol with its own unique properties, such as becoming Wild, as shown in the example below in which the game repositioned symbol A(1) from symbol position 1/1 to 1/2:

| | | | | |
|---|---|---|---|---|
| A(1) | B | F | F | D |
| C | E(2) | B | C | H |
| E(1) | A(2) | A(3) | A(4) | G |
| | | [Before Reposition] | | |
| ^ | B(2) | F | F | D |
| WILD | E(2) | B(3) | C | H |
| E(1) | A(2) | A(3) | A(4) | G |
| | | [After Reposition] | | |

By allowing symbol A(1) to merge with C to form a new Wild symbol in Symbol Position 1/2, the MVP results in 2 new Pays for the Contiguous Symbol combinations for left-to-right contiguous symbols: WILD-A(2)-A(3)-A(4), WILD-B(2)-B(3), plus the original E(1)-E(2).

Reveals another symbol in the position it vacates concealed underneath the symbol being repositioned, as shown in the example below in which the game repositioned symbol A(1) from Symbol Position 1/1 to 1/3 and reveals symbol B:

| | | | | |
|---|---|---|---|---|
| A(1) | B | F | F | D |
| C | E(2) | B | C | H |
| E(1) | A(2) | A(3) | A(4) | G |
| | | [Before Reposition] | | |
| B(1) | B(2) | F | F | D |
| C | E | B(3) | C | H |
| A(1) | A(2) | A(3) | A(4) | G |
| | | [After Reposition] | | |

By repositioning symbol A(1) and revealing symbol B, MVP results in two new Pays for the Contiguous Symbol combinations: A(1)-A(2)-A(3)-A(4) and B(1)-B(2)-B( 3).

Finally, the MVP bonus feature is not limited to games using Contiguous Symbols. MVP may be used with any base game, including other slot games that use Pay Lines and other payment methods.

Preferred Method

According to the principles of the present invention, a flowchart depicting one example of a process used to implement the game is illustrated in FIG. 5. To begin, the game checks player credits S02. If there are not sufficient credits, the game prompts the player to insert the needed currency S06. When that happens, S08, the game initializes player credits in accordance with a predetermined amount S10. Virtually any number of initial player credits can be offered.

However, it should be kept in mind that in the exemplary embodiment, the player can, for example, wager up to 45 credits per play (e.g., 9 symbols at 5 points per symbol). Thus, for example, if the player is awarded, say, 90 credits at the start of the game, the game would terminate after the second play unless the player won some additional credits in either the first and/or second play.

Then, the player is presented with a display that presents the player with a symbol matrix randomly S12. In step S14, the player optionally selects one or more of a plurality of symbols. Alternatively, the player can accept the default values for the number of symbols S16. The player then optionally selects the credits bet per spin S18, and again, he can accept the default values S20.

Next, the player spins to start the game S22 or can wait for the default spin S24, after either having selected his own symbol(s) and/or amount bet per symbol or accepting the default values for each.

After the spin, the credits bet are deducted from the total credits S26. If contiguous symbol credits (e.g., credits won as a result of there being two or more predetermined and/or player-selected symbols appearing contiguously beside each other) are won as determined in decision step S28, the won credits are added to the player's total S30.

Next, a determination is made as to whether any credits have been won as a result of various scatter pay possibilities (e.g., credits won randomly, and thus won optionally independent of any player selected symbol(s)) S32, S36, S40 and S44.

For each different scatter pay choice, a different process is activated. If scatter pay #1 appears S36, an animated monkey repositions a specific symbol to create the most valuable winning combination, and the resulting credits are added to the total S34. If scatter pay #2 appears S36, the player is awarded one times the total bet, and the credits are added to the total S38. If scatter pay #3 appears S40, a trapeze bonus game is triggered. If the player directs the animated monkey across trapeze bars successfully, credits are added to the total S42. Lastly, if scatter pay #4 appears S44, a cannonball game is triggered. The player shoots the monkey from a cannonball, and credits are awarded depending on the monkey's resulting position S46.

It should be understood that both of the different types of payout can occur. Thus, for any given round of the game, a player may receive contiguous symbol credits (as determined at S30), and/or scatter pay credits (as determined at S34, S38, S42 and S46.)

Finally, the game aggregates the player's wins or losses S48, and the player is able to stop playing or play again.

FIGS. 5–19 are illustrations of one exemplary embodiment of the present invention. In FIG. 5, a representative screen display 40 is illustrated. Above the reels, the 9 different symbols are presented, 44–60. In the preferred embodiment, the symbols on the left are the 'cheaper' symbols. That is, the symbols are more expensive from left to right. In other words, these symbols, while less expensive to wager on, also have a smaller payout. To wager 60, the big tent, the player must bet on all the previous symbols. The Pays button 66 will show the player the game's pay table to assist in betting. The help button 68 offers further assistance, if necessary. The player selects the number of symbols and this number is presented in 70, and then either selects the bet per symbol or is given the default value, and this number is shown in 72. These two values are multiplied to give the total bet in 75. The max bet button 74 automatically sets the credit wagered to the highest amount a player may bet on.

The player pushes the spin button 76 to start the reels. When the reels come to a stop, the game outlines any winning combinations, as is be shown in FIGS. 6–9. The paid meter 77 will displays the number of credits won on the last spin, while the credits meter 62 displays the total number of credits remaining in the credit pool.

Figure 6:
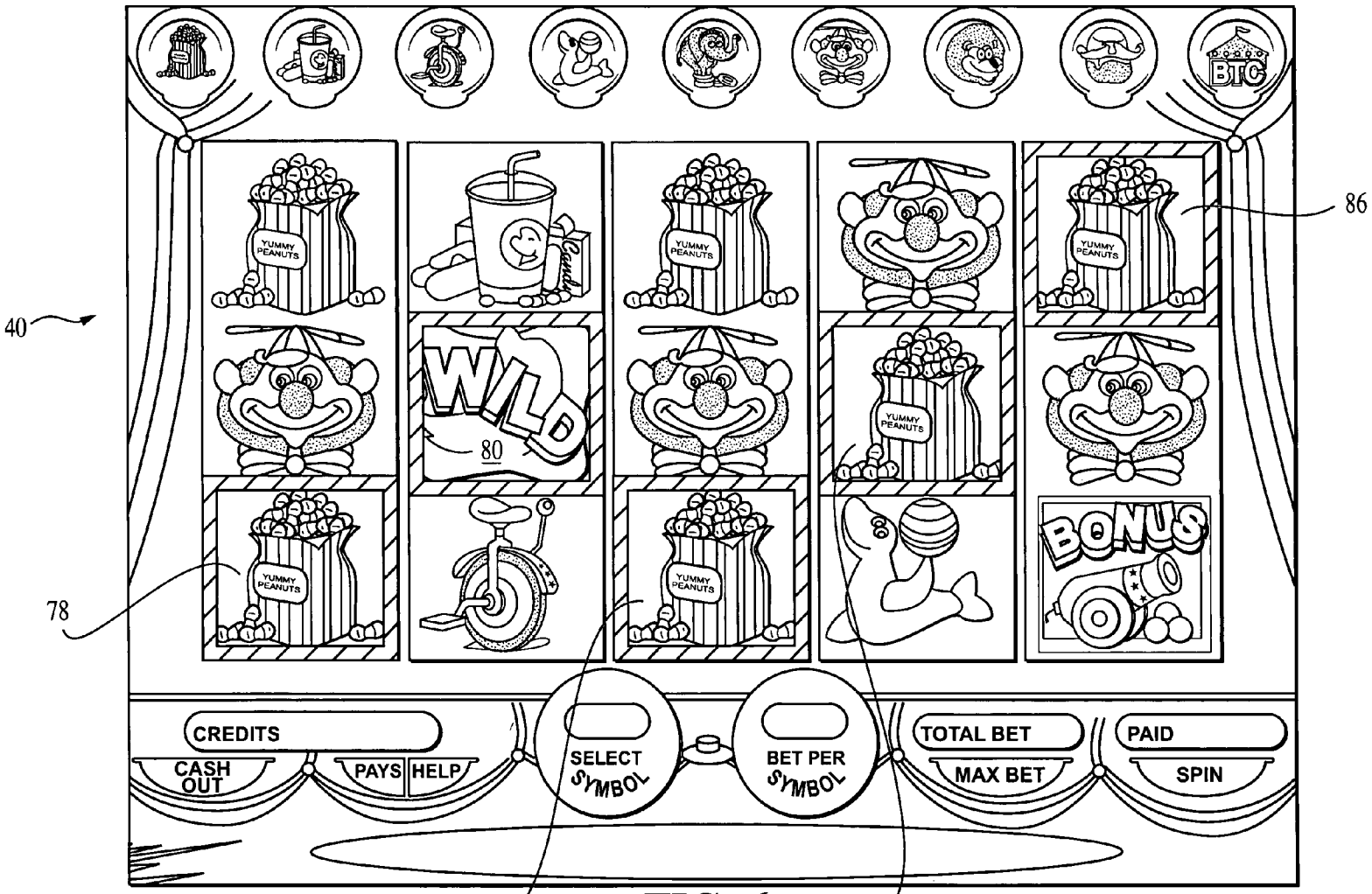
FIGS. 6–9 illustrate all of the different winning contiguous symbol combinations that appear in FIG. 5.
Figure 7:
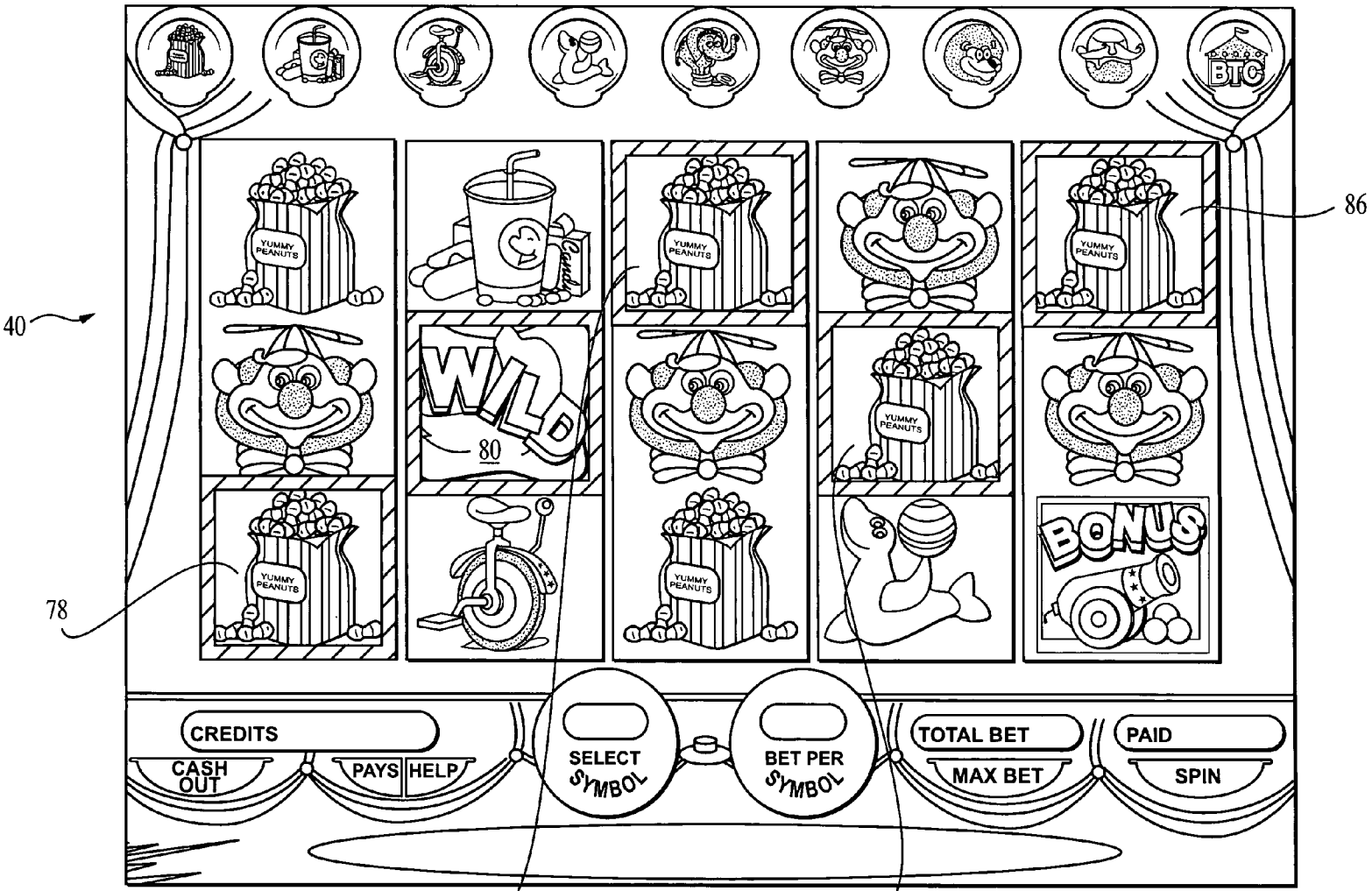
Figure 8:
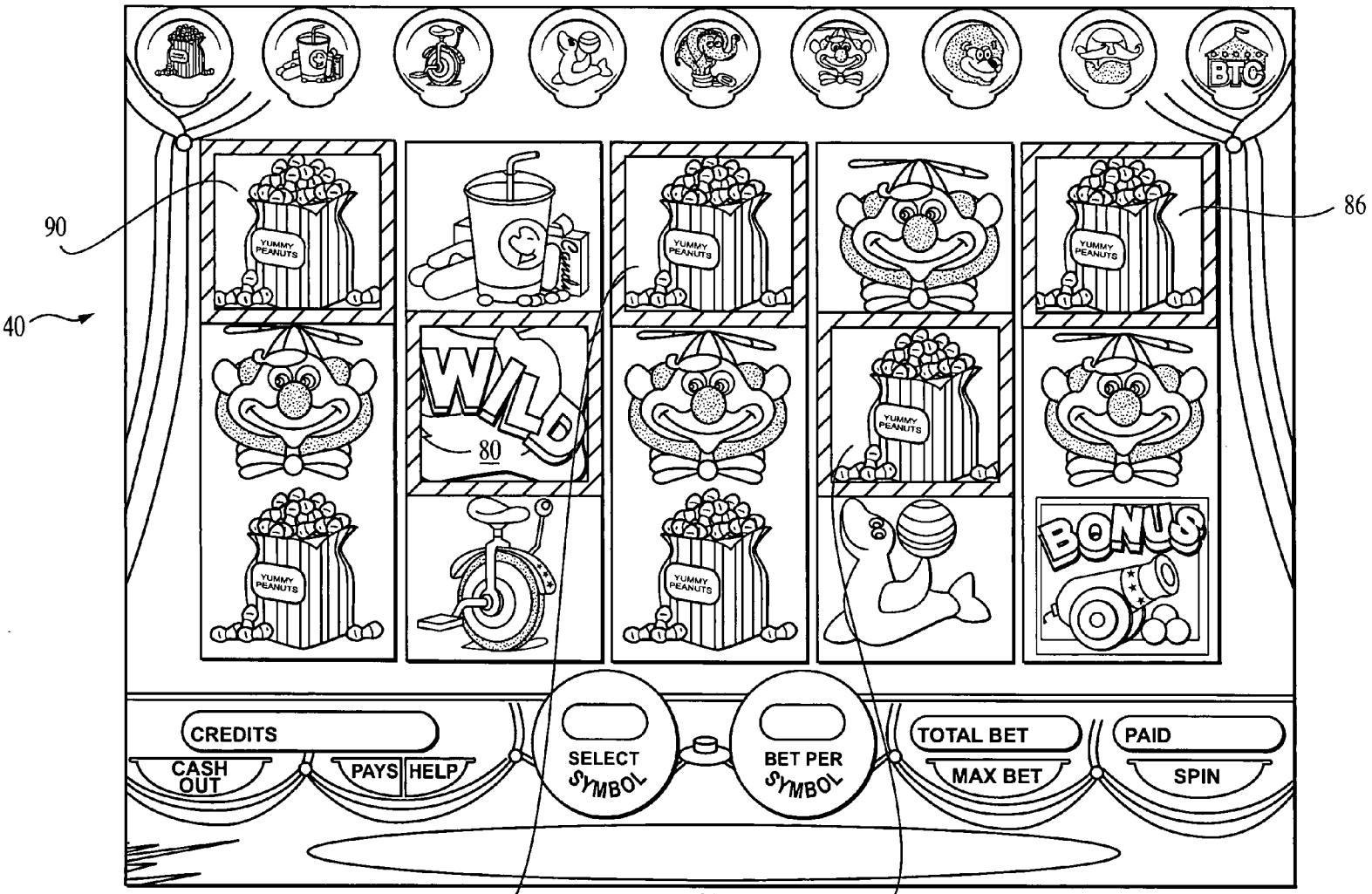
Figure 9:
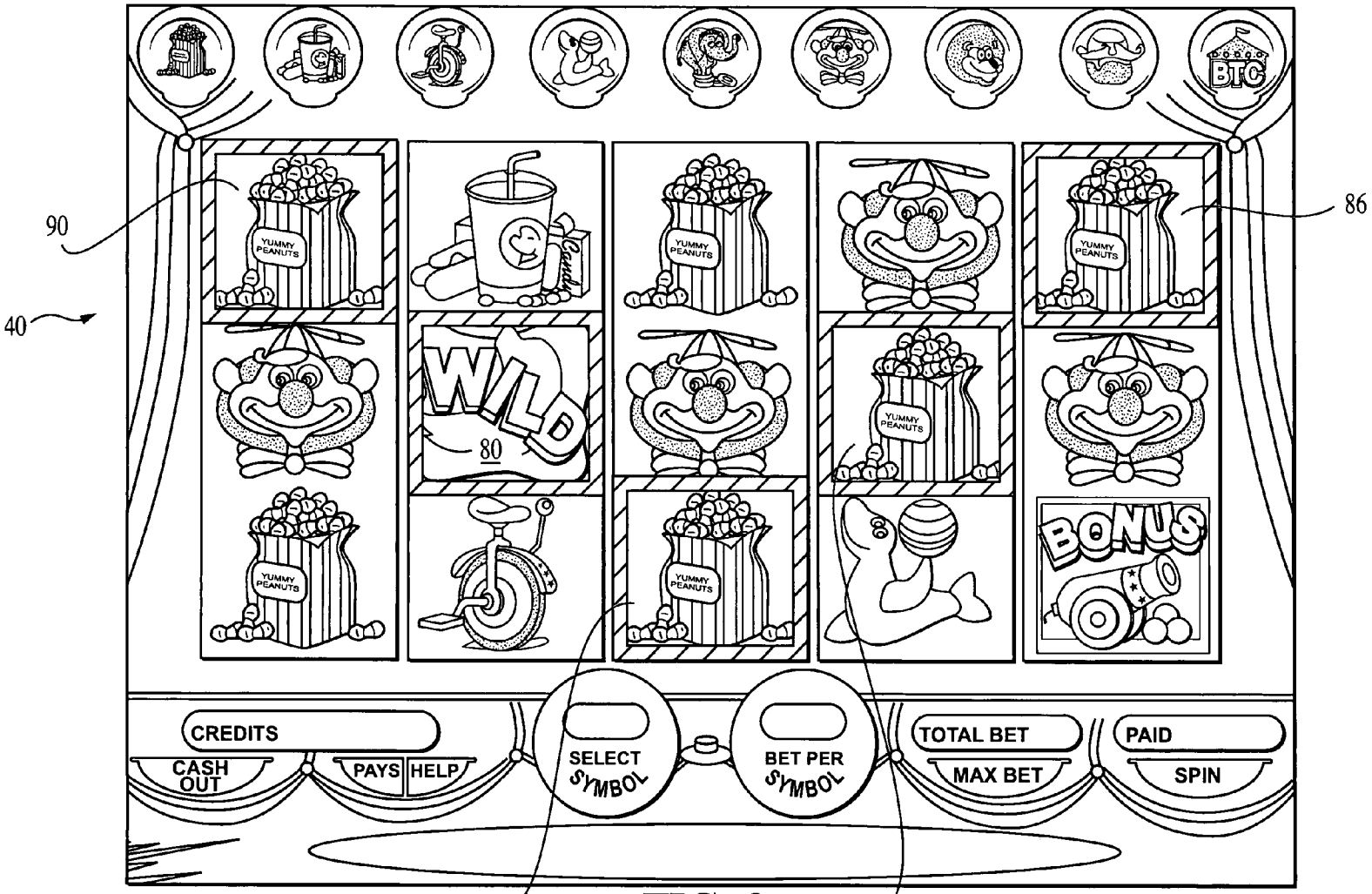

FIG. 6 shows one alternative contiguous symbol winning combination for display 40. Starting from the bottom left-most corner 78, and going to 80, 82, 84 and 86, the game highlights this winning combination. Yet as the next figure shows, there is more than one way to win. Because the individual bets on symbols rather than Pay Lines, this symbol and its particular arrangement creates 4 distinct high-paying combinations. FIG. 7 shows another combination starting with 78, and using 80, 88, 84, and 86. FIG. 8 illustrates the next winning combination using 90, 80, 88, 84, and 86. FIG. 9 displays the final winning combination of this screen, using 90, 80, 82, 84 and 86. These illustrations, taken together, emphasize the advantages of the Contiguous Symbol method; these combinations follow complicated lines, yet the player is still able to receive the maximum payout because he wagered on the symbols.

Figure 10:
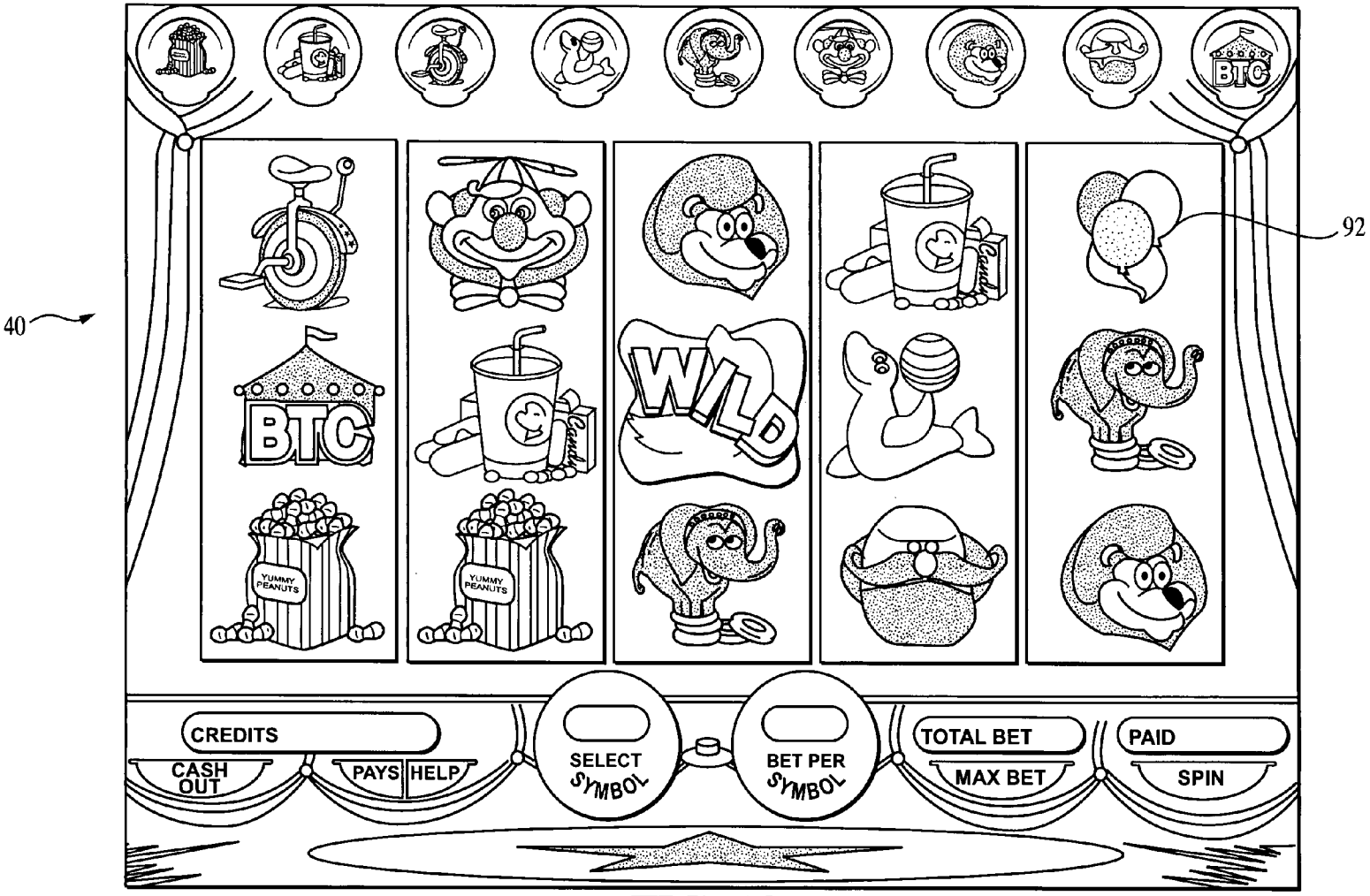
FIG. 10 shows an illustrative example of a representative display that may be encountered during a typical game in accordance with the principles of the present invention.

One of the bonus features of the present invention is revealed in FIG. 10. The balloon 92 in the display triggers the MVP scatter pay. This balloon will fill with air, come down from its position, and an animated monkey will run to the balloon and hang from its strings. The balloon will then move and drop the monkey at whatever symbol is to be moved to form the most valuable combination.

Figure 11:
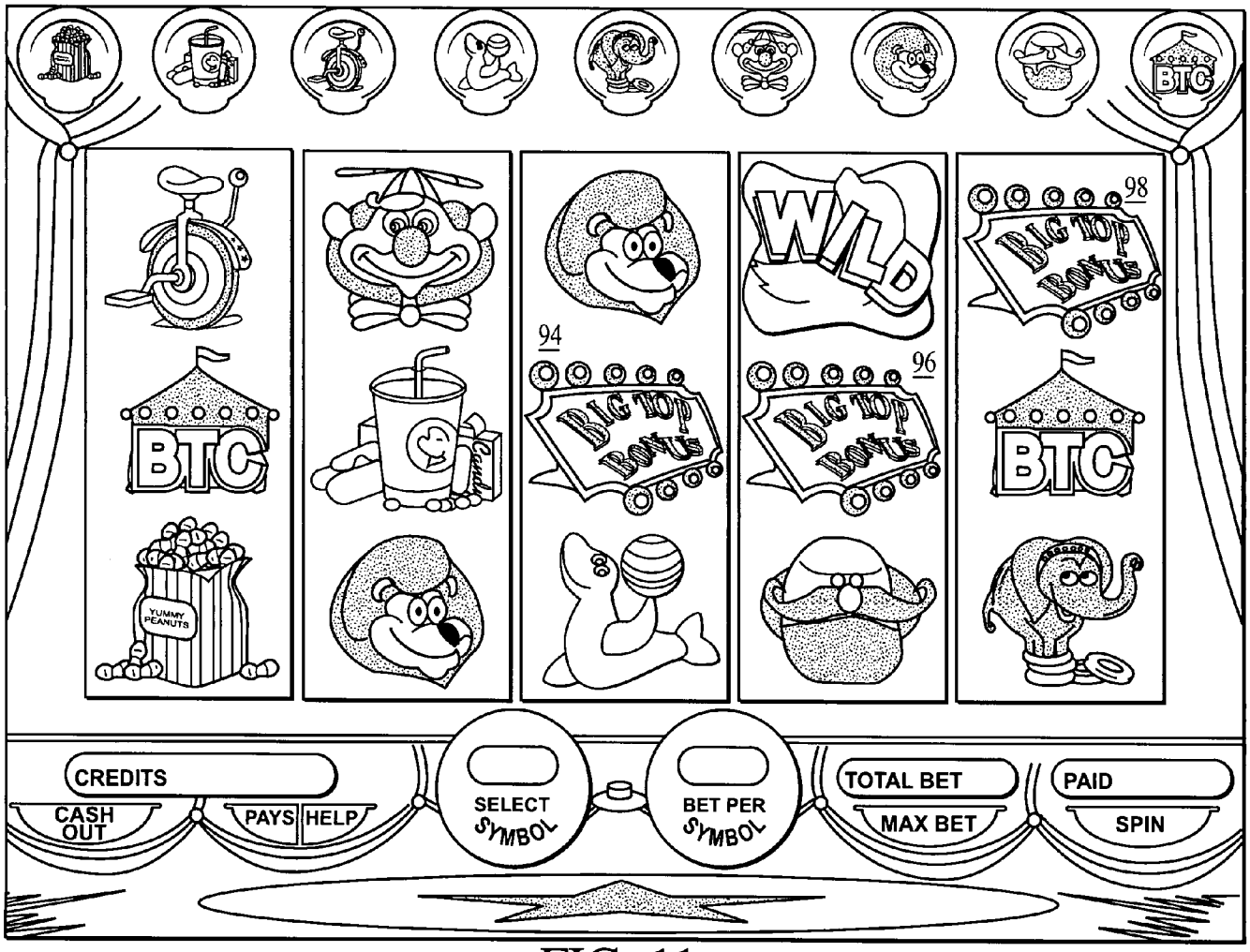
FIG. 11 shows an illustrative example of a representative display that may be encountered during a typical game in accordance with the principles of the present invention.
Figure 12:
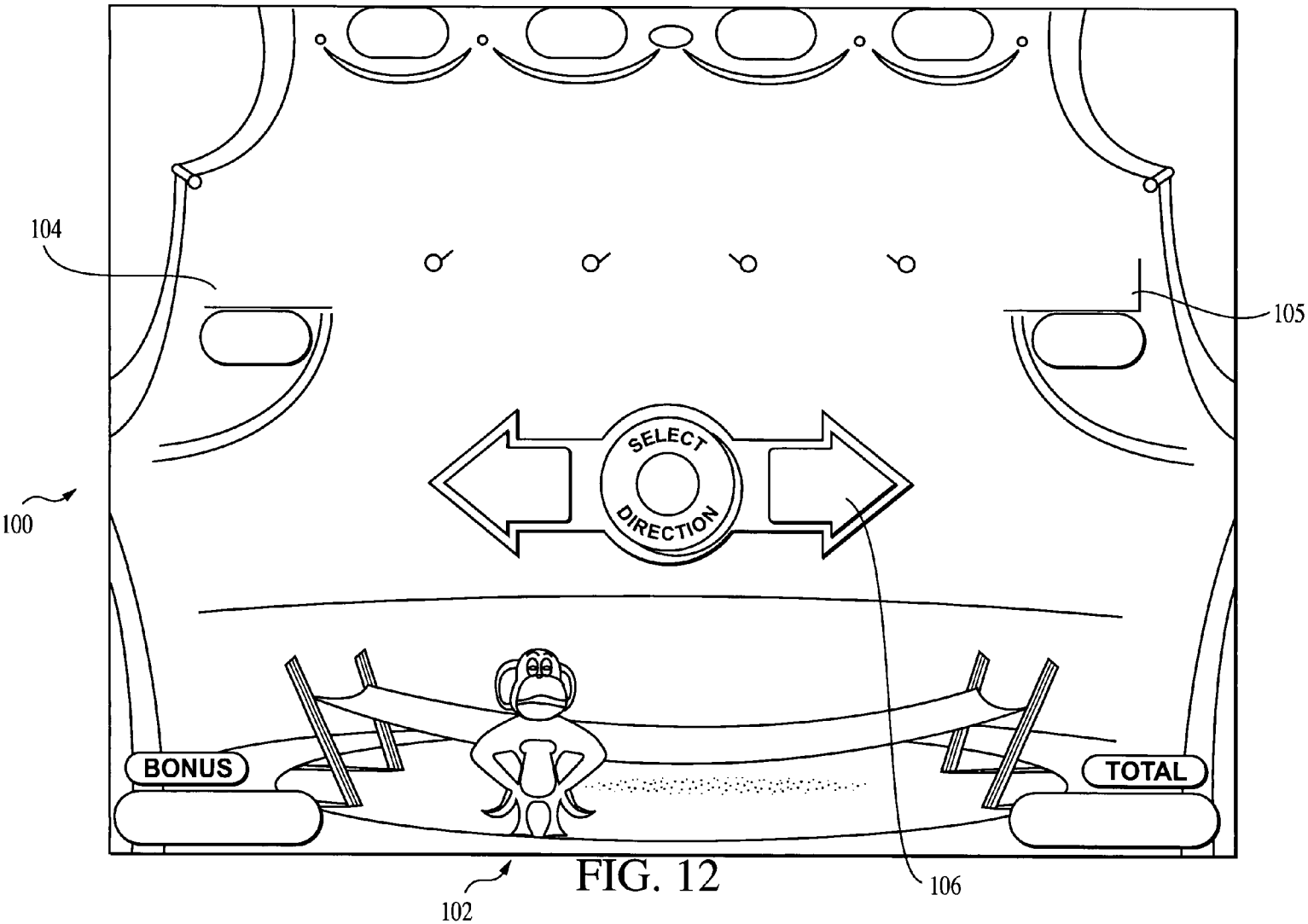
FIGS. 12–15 illustrate the various stages of a trapeze bonus game that is triggered by FIG. 11.
Figure 13:
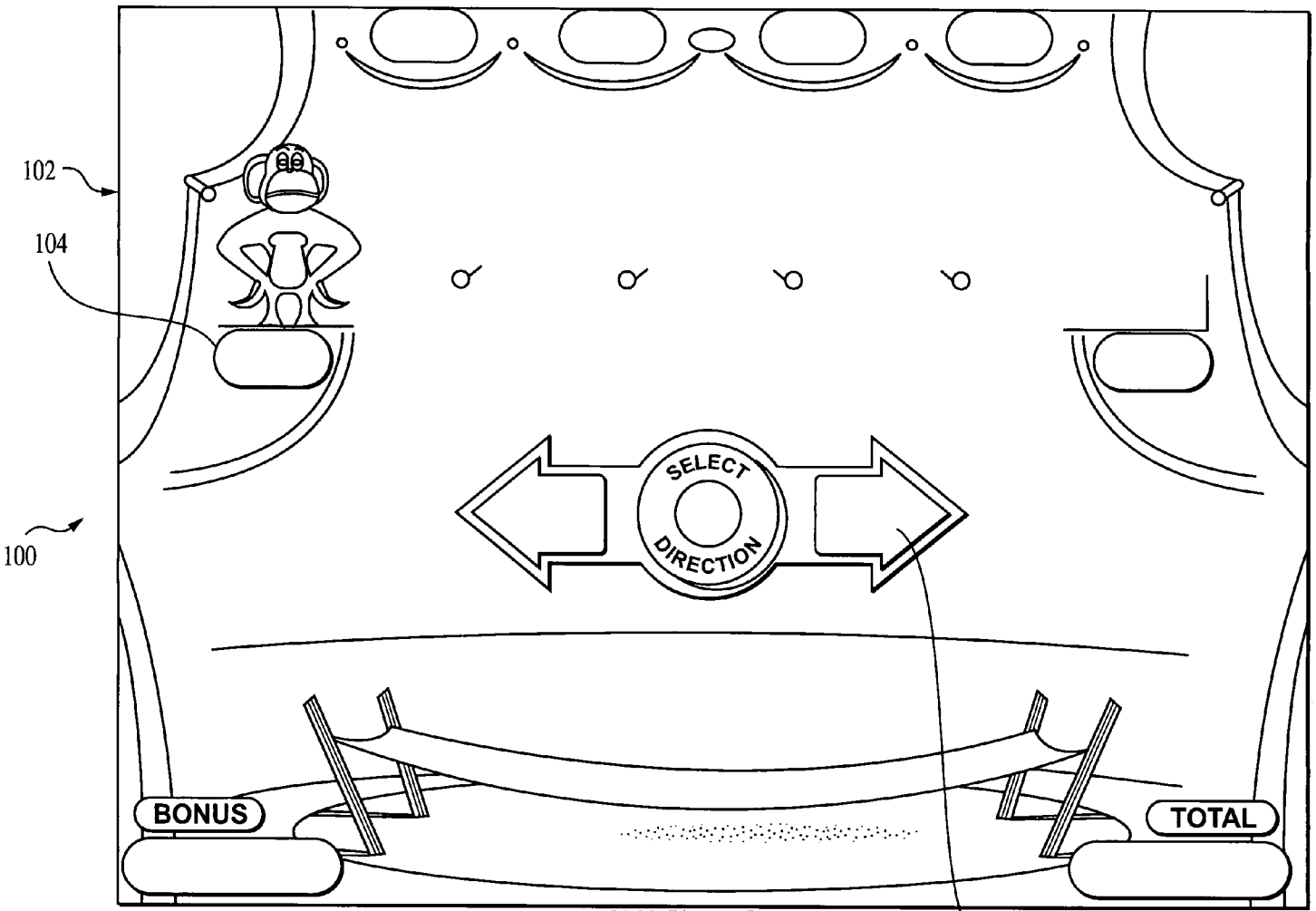
Figure 14:
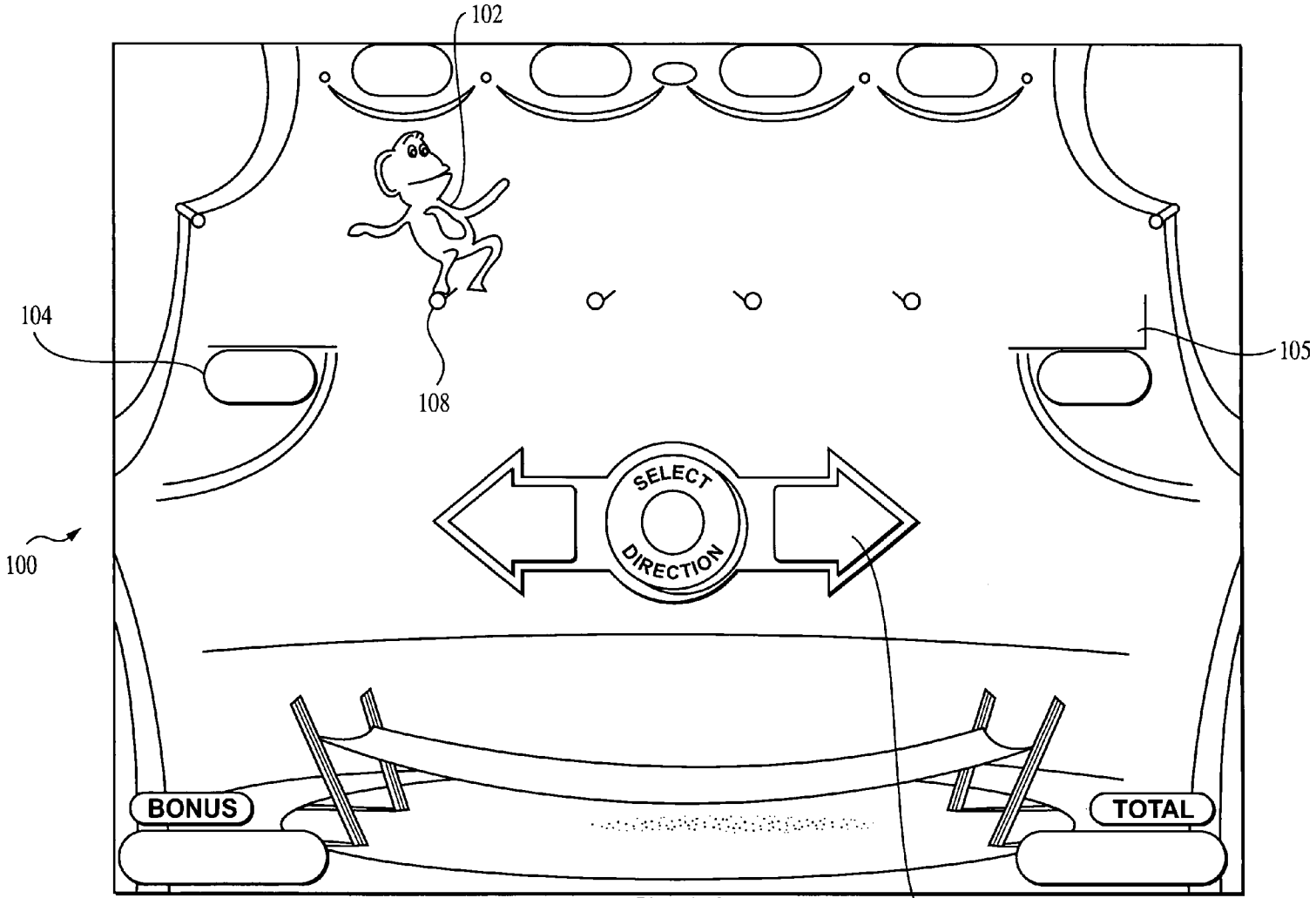
Figure 15:
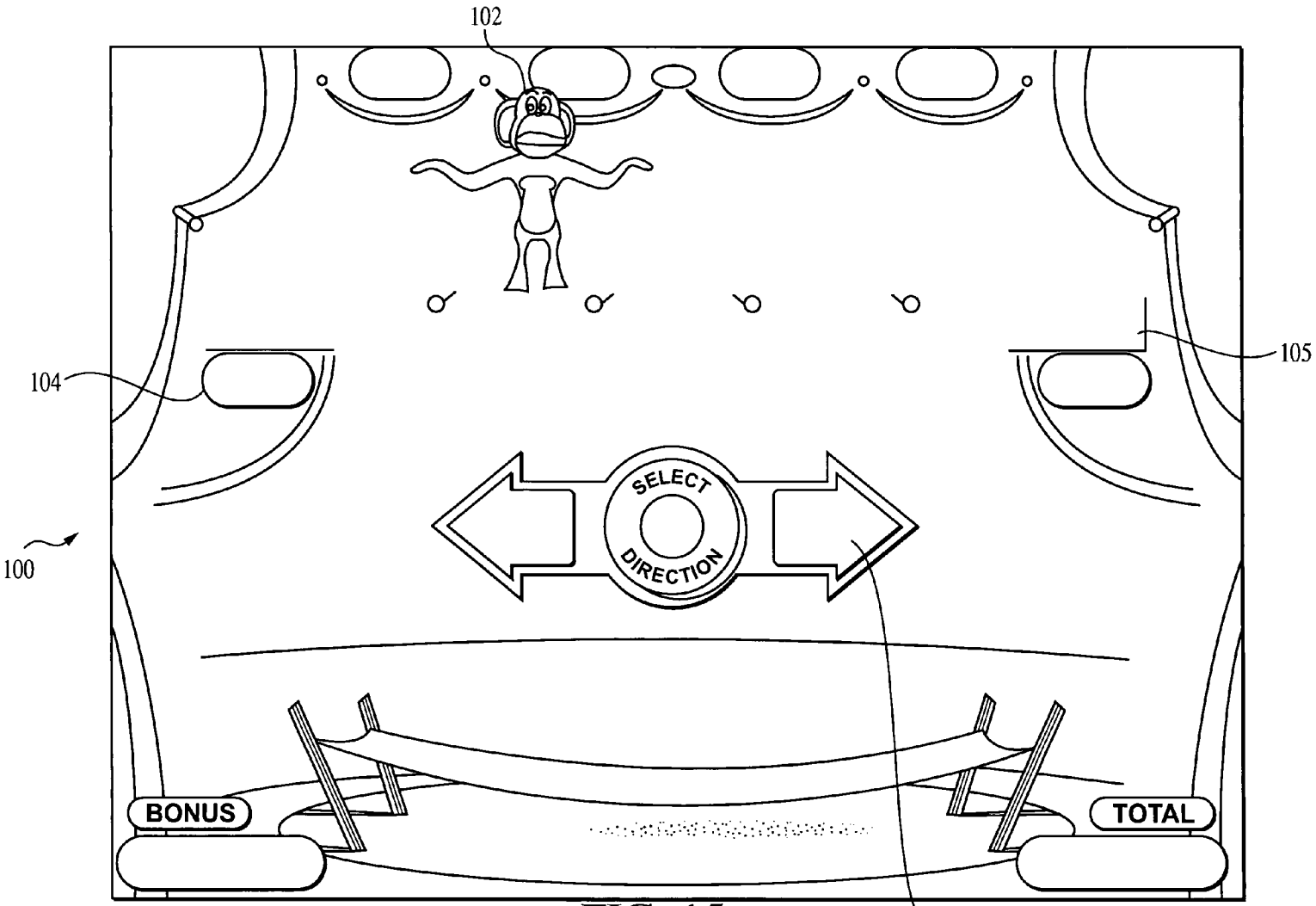
Figure 16:
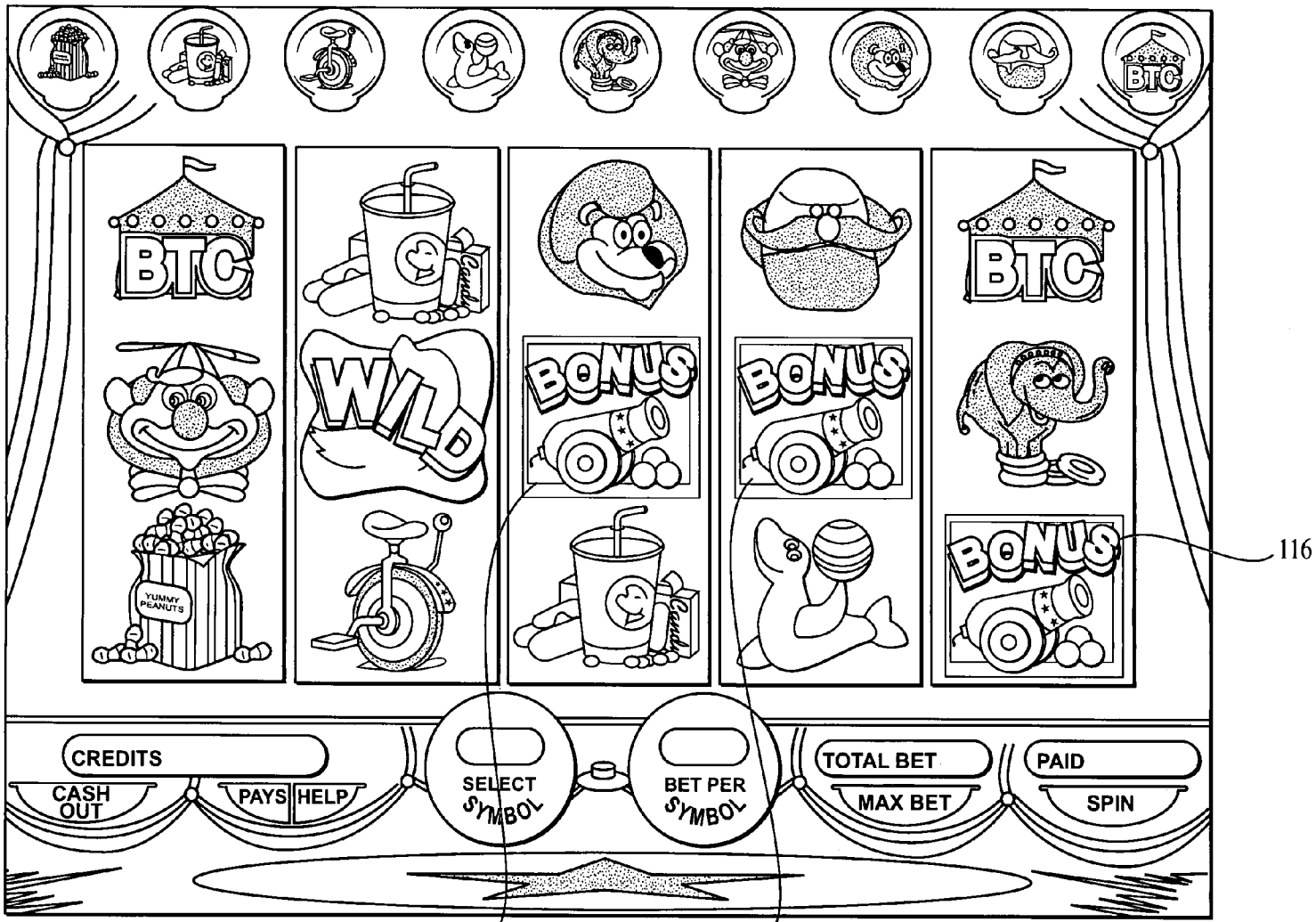
FIG. 16 shows an illustrative example of a representative display that may be encountered during a typical game in accordance with the principles of the present invention.

Another bonus feature of the present invention is shown in FIG. 11. This display shows three Big Top Bonus Tickets, 94, 96 and 98. These tickets trigger the bonus game in FIGS. 12–15. In FIG. 15, the screen 100 shows two platforms 104 and 105 separated by four trapeze bars. Each of these positions will list a different credit value. FIG. 16 shows the animated monkey 102 on the starting platform 104. To start, the monkey must jump onto the first trapeze. Once he has jumped to the first trapeze 108, as is shown in FIG. 14, and collected whatever credits were on that trapeze, the player, using the direction buttons 106, can direct the monkey whatever way he pleases. Whenever the monkey gets to the next point, he collects the credits associated with it. If the monkey falls in between the bars, as is illustrated in FIG. 15, he will fall into the net 112 with whatever credits he has accumulated, and the player returns to the main game.

Figure 17:
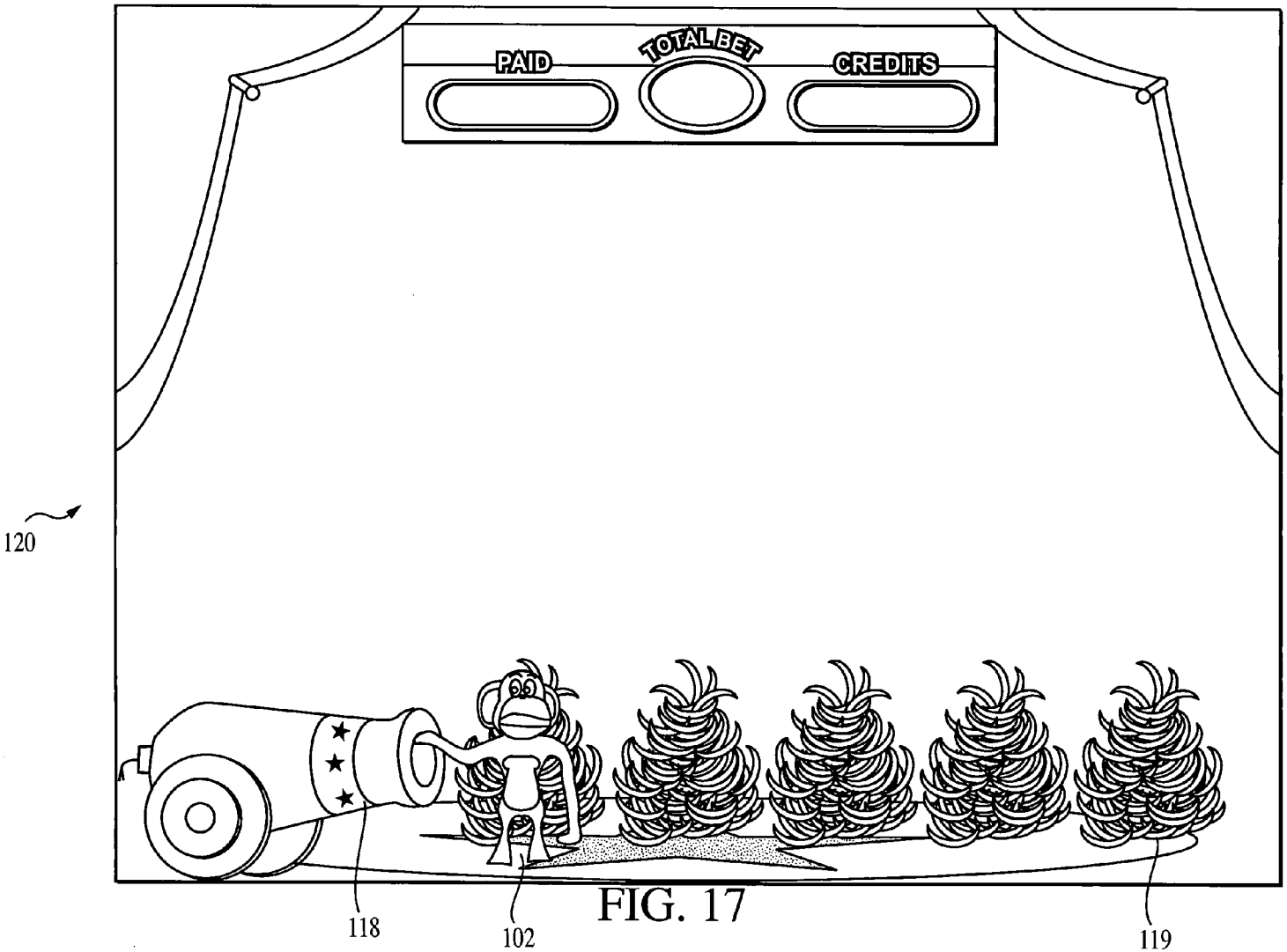
FIGS. 17–19 illustrate the various stages of a cannonball bonus game that is triggered by FIG. 16.
Figure 18:
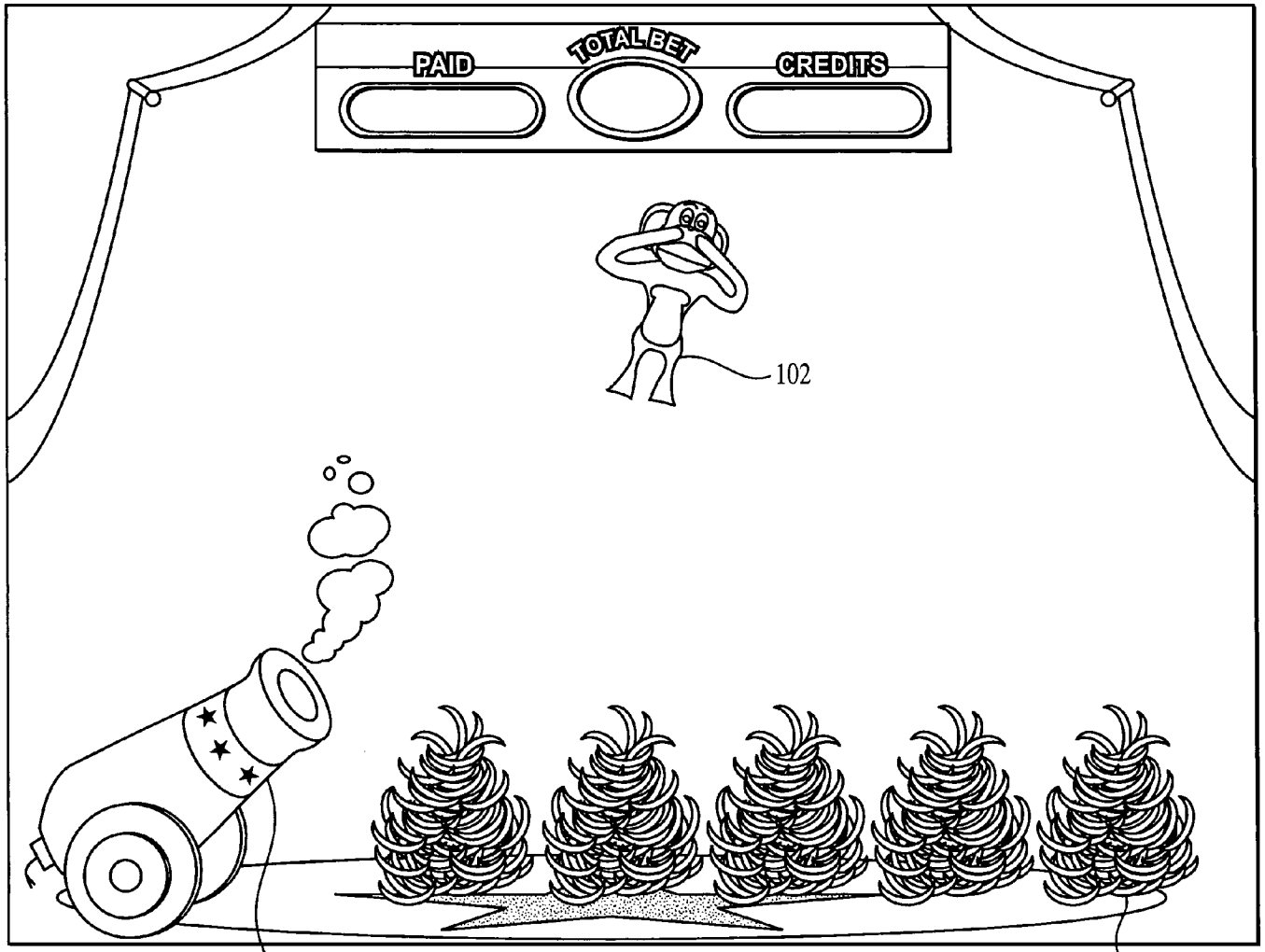
Figure 19:
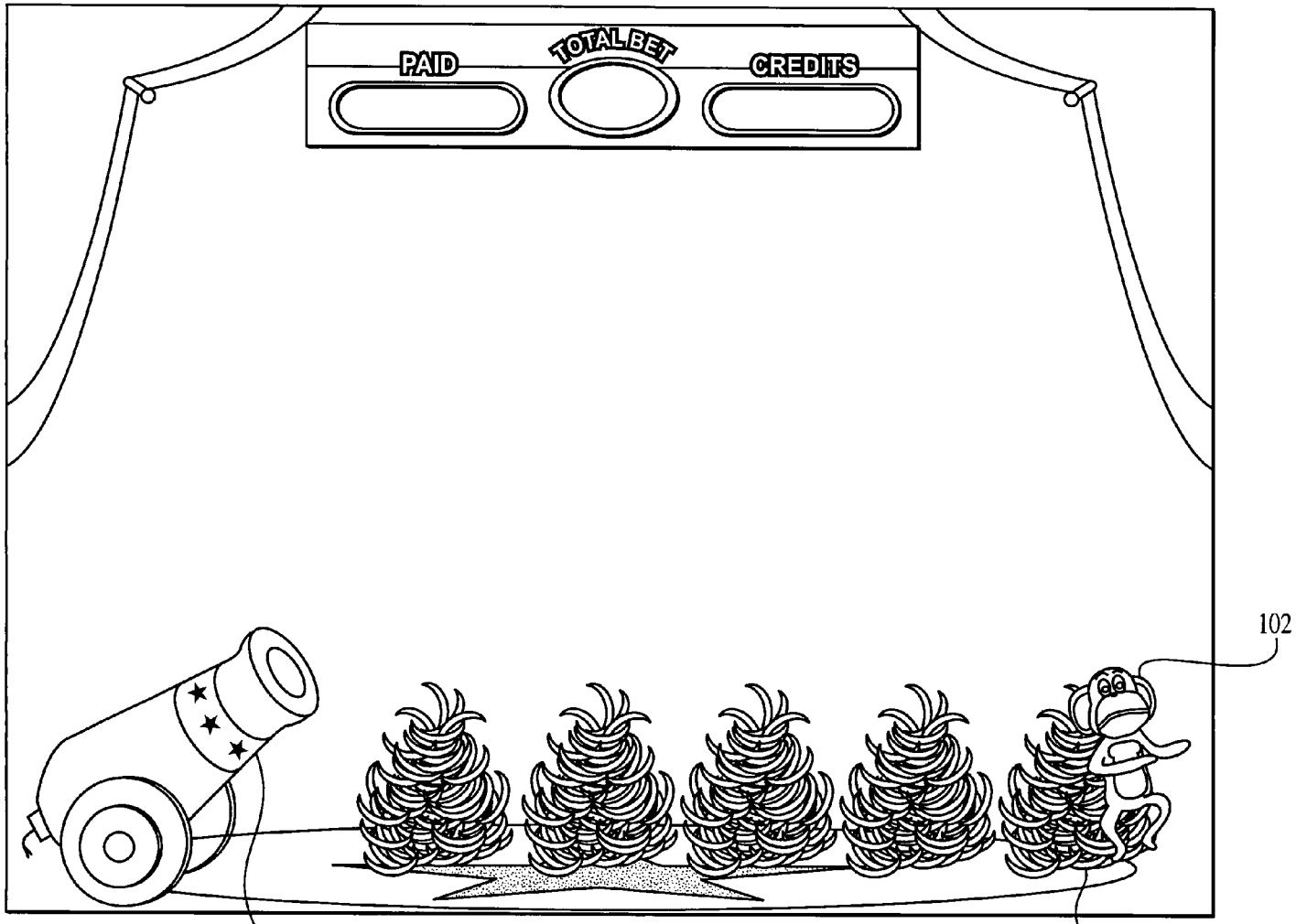

A different bonus feature of the game is triggered by the display in FIG. 16. The screen shows three bonus symbols, 112, 114, and 116. These cannon symbols activate the cannonball bonus game in FIGS. 17–19. In FIG. 17, the monkey 102 is shown standing next to the cannon 118 in front of five bunches of bananas. The monkey then enters the cannon, and is fired out, as is shown in FIG. 18. The monkey will then land in one of the five piles, and the further it goes, the more credits are awarded. In FIG. 19, the monkey has been fired into the last pile 119. While the player has no control over where the monkey lands, he does have the choice to accept or decline the win. The player gets 3 shots, so if, for example, the monkey lands in the middle pile, the player can decide whether to keep these credits or attempt to get more. If he shoots again and the monkey ends up in the first pile, the player loses the amount he would've won from that pile. Then, as no pile contains as few credits as the first, the player will shoot again. Wherever he ends up on this final spin will dictate how many credits are earned.

In alternative embodiments of the present invention, bonus features, such as Wild symbols and Scatter pays, do not necessarily result in the award of credits. The activation of the bonus feature may only result in a payout some percentage of the time. For example, Wild symbols appear on the screen without forming a Contiguous Symbol combination; Scatter Symbols may require the presence of another element, such as another special Symbol. In the preferred embodiment of the present invention, Wild symbols do not always result in winning symbol combinations, however, Scatter pays always result in the award of credits.

The present invention is not constrained to parameters listed above. It should also be understood that the present invention may take various forms as different types of competitions or bonus games, and is not limited to the trapeze or cannonball games described in the preferred embodiment. For example, different competitions which allow the player to collect credits are within the scope of the present invention.

Furthermore, the rules regarding the formation of Contiguous Symbol combinations may include any combination of starting points and directions, to allow for higher number of paying Contiguous Symbol combinations. The number of symbols required to form a paying Contiguous Symbol combination may be more than two. However, it is preferable to minimize the number of contiguous symbols required to allow for higher number of paying Contiguous Symbol combinations. The number of Symbols used in a game is also not critical; more or less than 13 symbols in the symbol set can be used. However it is preferable to have at least seven symbols within the symbol set to provide mathematical combinations in sufficient amounts to offer reasonable winning payouts.

General Purpose Computer and Computer-Readable Medium

Figure 20:
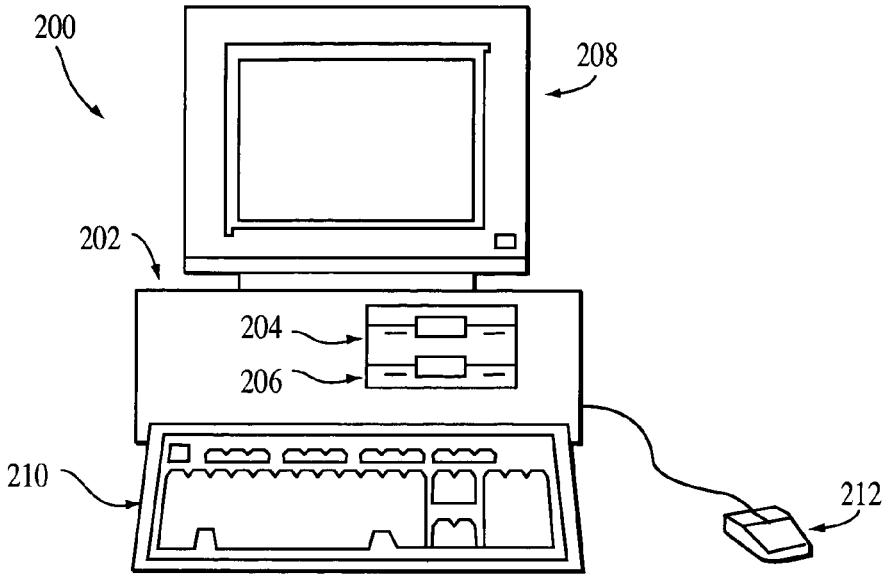
FIG. 20 illustrates one example of a central processing unit for implementing a computer process in accordance with a computer implemented stand-alone embodiment of the present invention.

The techniques of the present invention may be implemented on standard stand-alone casino gaming devices, as well as in a computing unit such as that depicted in FIG. 20. In this regard, FIG. 20 is an illustration of a main central processing unit which is also capable of implementing some or all of the computer processing in accordance with a computer implemented embodiment of the present invention. The procedures described herein are presented in terms of program procedures executed on, for example, a computer or network of computers.

Viewed externally in FIG. 20 a computer system designated by reference numeral 200 has a computer 202 having disk drives 204 and 206. Disk drive indications 204 and 206 are merely symbolic of a number of disk drives which might be accommodated by the computer system. Typically, these would include a floppy disk drive 204, a hard disk drive (not shown externally) and a CD ROM indicated by slot 206. The number and type of drives vary, typically with different computer configurations. Disk drives 204 and 206 are in fact optional, and for space considerations, are easily omitted from the computer system used in conjunction with the production process/apparatus described herein.

The computer system also has an optional display 208 upon which information, such as the screens illustrated in FIGS. 12–15, may be displayed. In some situations, a keyboard 210 and a mouse 212 are provided as input devices through which a player's actions may be inputted, thus allowing input to interface with the central processing unit 202. Then again, for enhanced portability, the keyboard 210 is either a limited function keyboard or omitted in its entirety. In addition, mouse 212 optionally is a touch pad control device, or a track ball device, or even omitted in its entirety as well, and similarly may be used to input a player's selections. In addition, the computer system may also optionally include at least one infrared transmitter and/or infrared received for either transmitting and/or receiving infrared signals. Instead of utilizing an infrared transmitter or infrared receiver, the computer system optionally uses a low power radio transmitter and/or a low power radio receiver. The low power radio transmitter transmits the signal for reception by components of the production process, and receives signals from the components via the low power radio receiver. The low power radio transmitter and/or receiver are standard devices in industry.

Although computer system 200 is illustrated having a single processor, a single hard disk drive and a single local memory, the system 200 is optionally suitably equipped with any multitude or combination of processors or storage devices. Computer system 200 is, in point of fact, able to be replaced by, or combined with, any suitable processing system operative in accordance with the principles of the present invention, including sophisticated calculators, and hand-held, laptop/notebook, mini, mainframe and super computers, as well as processing system network combinations of the same.

Figure 21:
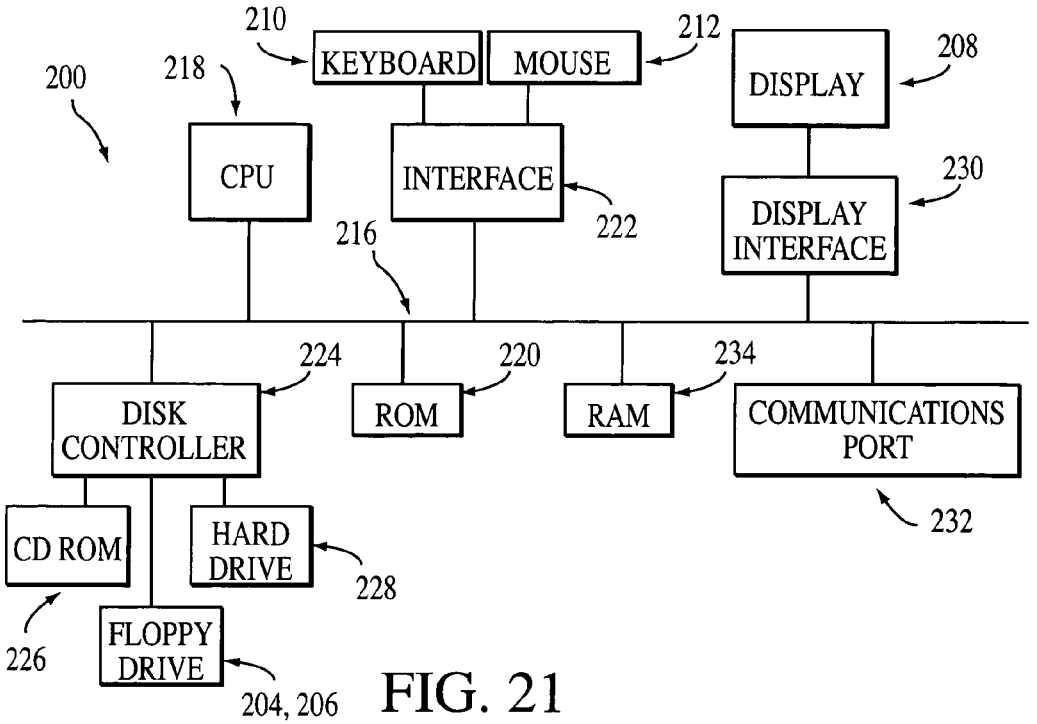
FIG. 21 illustrates one example of a block diagram of internal hardware of the central processing unit of FIG. 20.

FIG. 21 illustrates a block diagram of the internal hardware of the computer system 200 of FIG. 20. A bus 216 serves as the main information highway interconnecting the other components of the computer system 200. CPU 218 is the central processing unit of the system, performing calculations and logic operations required to execute a program. Read only memory (ROM) 220 and random access memory (RAM) 234 constitute the main memory of the computer. Disk controller 224 interfaces one or more disk drives to the system bus 216. These disk drives are, for example, floppy disk drives such as 204 or 206, or CD ROM or DVD (digital video disks) drive such as 226, or internal or external hard drives 228. As indicated previously, these various disk drives and disk controllers are optional devices.

A display interface 222 interfaces display 208 and permits information from the bus 216 to be displayed on the display 208. Again as indicated, display 208 is also an optional accessory. For example, display 208 could be substituted or omitted. Communications with external devices, for example, the other components of the system described herein, occur utilizing communication port 232. For example, optical fibers and/or electrical cables and/or conductors and/or optical communication (e.g., infrared, and the like) and/or wireless communication (e.g., radio frequency (RF), and the like) can be used as the transport medium between the external devices and communication port 232. Peripheral interface 230 interfaces the keyboard 210 and the mouse 212, permitting input data to be transmitted to the bus 216.

Conventional processing system architecture is more fully discussed in *Computer Organization and Architecture*, by William Stallings, MacMillan Publishing Co. (3rd ed. 1993); conventional processing system network design is more fully discussed in *Data Network Design*, by Darren L. Spohn, McGraw-Hill, Inc. (1993), and conventional data communications are more fully discussed in *Data Communications Principles*, by R. D. Gitlin, J. F. Hayes and S. B. Weinstain, Plenum Press (1992) and in *The Irwin Handbook of Telecommunications*, by James Harry Green, Irwin Professional Publishing (2nd ed. 1992). Each of the foregoing publications is incorporated herein by reference. Alternatively, the hardware configuration is, for example, arranged according to the multiple instruction multiple data (MIMD) multiprocessor format for additional computing efficiency. The details of this form of computer architecture are disclosed in greater detail in, for example, U.S. Pat. No. 5,163,131; Boxer, A., Where Buses Cannot Go, IEEE Spectrum, February 1995, pp. 41–45; and Barroso, L. A. et al., RPM: A Rapid Prototyping Engine for Multiprocessor Systems, IEEE Computer February 1995, pp. 26–34, all of which are incorporated herein by reference.

In alternate preferred embodiments, the above-identified processor, and, in particular, CPU 218, may be replaced by or combined with any other suitable processing circuits, including programmable logic devices, such as PALs (programmable array logic) and PLAs (programmable logic arrays). DSPs (digital signal processors), FPGAs (field programmable gate arrays), ASICs (application specific integrated circuits), VLSIs (very large scale integrated circuits) or the like.

Figure 22:
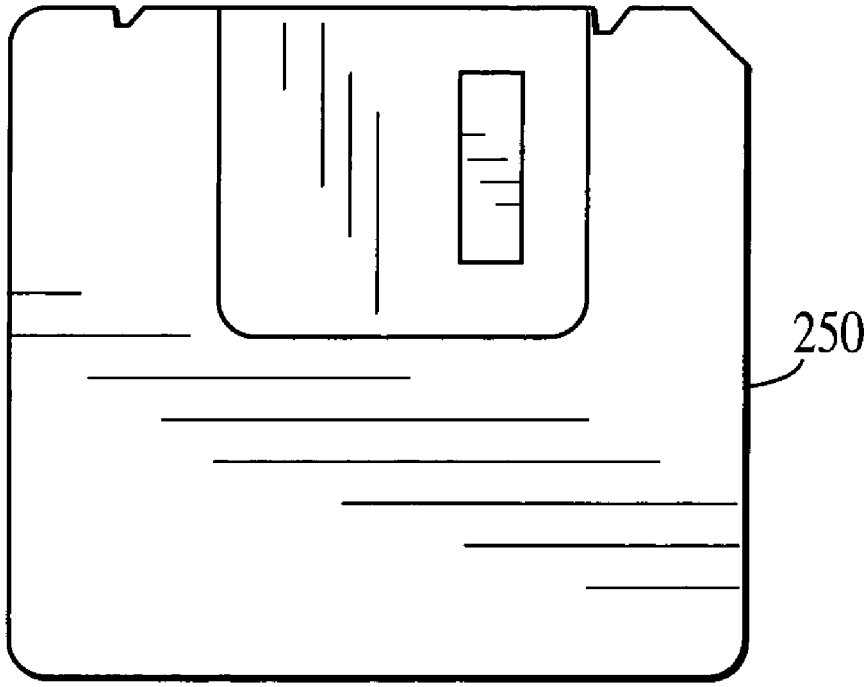
FIG. 22 illustrates one example of a memory medium which may be used for storing a computer implemented process of the present invention.

FIG. 22 is an illustration of an exemplary memory medium 250 which can be used with disk drives illustrated in FIGS. 20 and 21. Typically, memory media such as floppy disks, or a CD ROM, or a digital video disk will contain, for example, a multi-byte locale for a single byte language and the program information for controlling the computer to enable the computer to perform the functions described herein. Alternatively, ROM 220 and/or RAM 234 illustrated in FIGS. 20 and 21 can also be used to store the program information that is used to instruct the central processing unit 218 to perform the operations associated with the production process.

Figure 23:
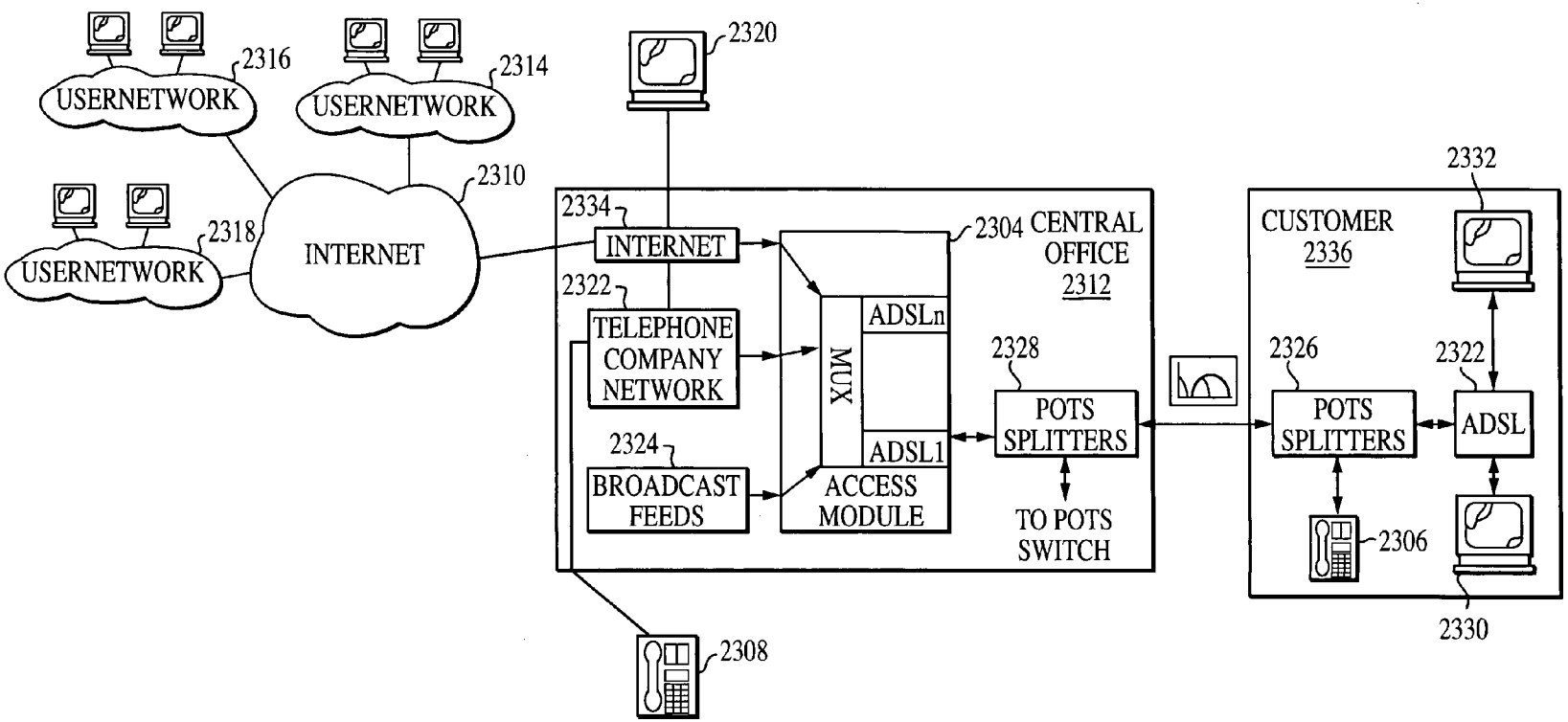
FIG. 23 illustrates an example of a combined Internet, POTS, and ADSL architecture which may be used with the present invention.

FIG. 23 is an illustration of the architecture of the combined Internet, POTS (plain, old, telephone service), and ADSL (asymmetric, digital, subscriber line) for use in accordance with the principles of the present invention. Furthermore, it is to be understood that the use of the Internet, ADSL, and POTS are for exemplary reasons only and that any suitable communications network may be substituted without departing from the principles of the present invention. This particular example is briefly discussed below.

In FIG. 23, to preserve POTS and to prevent a fault in the ADSL equipment 2302, 2304 from compromising analog voice traffic 2306, 2308 the voice part of the spectrum (the lowest 4 kHz) is separated from the rest by a passive filter, called a POTS splitter 2326, 2328. The rest of the available bandwidth, from about 10 kHz to 1 MHz, carries data at rates up to 6 bits per second for every hertz of bandwidth from data equipment 2330, 2332, and 2320. The ADSL equipment 2322 then has access to a number of destinations including significantly the Internet 2310, and other destinations 2322, 2324, 2334.

To exploit the higher frequencies, ADSL makes use of advanced modulation techniques, of which the best known is the discrete multitone (DMT) technology. As its name implies, ADSL transmits data asymmetrically (i.e., at different rates upstream toward the central office 2312 and downstream toward the subscriber 2336).

Cable television providers are providing analogous Internet service to PC players over their TV cable systems by means of special cable modems. Such modems are capable of transmitting up to 30 Mb/s over hybrid fiber/coax system, which use fiber to bring signals to a neighborhood and coax to distribute it to individual subscribers.

Cable modems come in many forms. Most create a downstream data stream out of one of the 6-MHz TV channels that occupy spectrum above 50 MHz (and more likely 550 MHz) and carve an upstream channel out of the 5–50-MHz band, which is currently unused. Using 64-state quadrature amplitude modulation (64 QAM), a downstream channel can realistically transmit about 30 Mb/s (the oft-quoted lower speed of 10 Mb/s refers to PC rates associated with Ethernet connections). Upstream rates differ considerably from vendor to vendor, but good hybrid fiber/coax systems can deliver upstream speeds of a few megabits per second. Thus, like ADSL, cable modems transmit much more information downstream than upstream. Then Internet architecture 2310 and ADSL architecture 2302, 2304 may also be combined with, for example, player networks 2014, 2016, and 2018.

In accordance with the principles of the present invention, in one example, a main game server implementing the process of the invention may be located on one computing node or terminal (e.g., on player network 2314, or system 2320). Then, various players may interface with the main game server via, for instance, the ADSL equipment discussed above, and play the game from remotely located PCs. In this manner, a game owner may be able to attract players located at other parts of the country or planet.

Furthermore, the game according to the present invention may also be implemented manually. For instance, it is possible to play the game of the present invention as a standard slot machine or a mechanical slot machine having an expanded display area are previously discussed herein.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible without departing from the scope of the invention defined in the following claims.

What is claimed is:

1. A method of playing a slot machine game using a symbol matrix formed by a plurality of rows intersecting a plurality of columns, the plurality of rows and columns including a plurality of symbols, comprising the steps of:

(a) wagering upon at least one symbol from the plurality of symbols;

(b) randomly rearranging the plurality of symbols;

(c) displaying the rearranged symbols; and (d) issuing awards based upon the appearance of two or more symbols wagered upon appearing in adjacent to each other in the symbol matrix, in addition to, or instead of, issuing another award based on the appearance of other of the plurality of symbols not wagered upon appearing on a payline.

2. A method of playing a game according to claim 1, wherein said wagering step (a) further comprises the step of wagering on all of the symbols from the plurality of symbols.

3. A method of playing a game according to claim 1, wherein said wagering step (a) further comprises the step of wagering upon a subset of the symbols from the plurality of symbols.

4. A method of playing a game according to claim 1, wherein said wagering step (a) further comprises the step of wagering the same amount on each of the symbols from the plurality of symbols.

5. A method of playing a game according to claim 1, wherein said wagering step (a) further comprises the step of wagering a different amount on each of the symbols from the plurality of symbols.

6. A method of playing a game according to claim 1, wherein said wagering step (a) further comprises the step of wagering upon each of the symbols from the plurality of symbols in a predetermined order.

7. A method of playing a game according to claim 1, wherein said wagering step (a) further comprises the step of wagering upon each of the symbols from the plurality of symbols in any order.

8. A method of playing a game according to claim 1, wherein said awarding step (d) further comprises the step of awarding the player based upon the appearance of two or more same symbols wagered upon appearing adjacent to each other.

9. A method of playing a game according to claim 1, wherein said awarding step (d) further comprises the step of issuing awards based upon the appearance of two or more different symbols wagered upon appearing adjacent to each other.

10. A method of playing a game according to claim 1, wherein said awarding step (d) further comprises the step of issuing awards based upon the appearance of one or more symbols wagered upon and one or more wildcard symbols not wagered upon appearing adjacent to each other.

11. A method of playing a game according to claim 1, wherein said awarding step (d) further comprises the step of issuing awards based upon the appearance of two or more symbols wagered upon appearing adjacent to each other in at least one of a horizontal, vertical and diagonal direction.

12. A method of playing a game according to claim 1, wherein said awarding step (d) further comprises the step of issuing awards based upon the appearance of two or more symbols wagered upon appearing adjacent, with at least one of said symbols appearing in the leftmost column of the symbol matrix.

13. A method of playing a game according to claim 1, wherein said awarding step (d) further comprises the step of issuing awards based upon the appearance of two or more symbols wagered upon appearing adjacent, with at most one of said symbols appearing in each column of the symbol matrix.

14. A method of playing a slot machine game using a symbol matrix formed by a plurality of rows intersecting a plurality of columns, the plurality of rows and columns including a plurality of symbols, comprising the steps of:

(a) wagering upon symbols in the plurality of symbols to be arranged in a predetermined order;

(b) randomly rearranging the plurality of symbols;

(c) displaying the rearranged symbols; and (d) issuing awards based upon the appearance of two or more same symbols wagered upon appearing:

(1) with said symbols wagered upon in adjacent to each other in the symbol matrix;

(2) with said symbols wagered upon adjacent to each other in horizontal or diagonal directions;

(3) with at least one of said symbols wagered upon appearing in the leftmost column of the symbol matrix; and (4) with at most one of said symbols wagered upon appearing in each column of the symbol matrix.

15. A method of playing a slot machine game using a symbol matrix formed by a plurality of rows intersecting a plurality of columns, the plurality of rows and columns including a plurality of symbols, comprising the steps of:

(a) randomly rearranging the plurality of symbols;

(b) displaying the rearranged symbols; and (c) issuing awards based upon the appearance of two or more same symbols appearing:

(1) with said symbols in adjacent to each other in the symbol matrix; and (2) with said symbols adjacent to each other in horizontal, vertical and/or diagonal directions.

16. A method of playing a slot machine game using a symbol matrix formed by a plurality of rows intersecting a plurality of columns, the plurality of rows and columns including a plurality of symbols, comprising the steps of:

(a) randomly rearranging the plurality of symbols;

(b) displaying the rearranged symbols; and (c) issuing awards based upon the appearance of two or more same symbols appearing:

(1) with said symbols in adjacent to each other in the symbol matrix;

(2) with said symbols adjacent to each other in horizontal, vertical and/or diagonal directions; and (3) with at least one of said symbols appearing in the leftmost column of the symbol matrix.

17. A method of playing a slot machine game using a symbol matrix formed by a plurality of rows intersecting a plurality of columns, the plurality of rows and columns including a plurality of symbols, comprising the steps of:

(a) randomly rearranging the plurality of symbols;

(b) displaying the rearranged symbols; and (c) issuing awards based upon the appearance of two or more same symbols appearing:

(1) with said symbols in adjacent to each other in the symbol matrix;

(2) with said symbols adjacent to each other in horizontal, vertical and/or diagonal directions;

(3) with at least one of said symbols appearing in the leftmost column of the symbol matrix; and (4) with at most one of said symbols appearing in each column of the symbol matrix.

* * * * *